US007196697B2

(12) United States Patent
Yamazaki

(10) Patent No.: US 7,196,697 B2
(45) Date of Patent: Mar. 27, 2007

(54) DISPLAY DEVICE, DRIVE CIRCUIT THEREOF, DRIVING METHOD THEREFOR, AND ELECTRONIC EQUIPMENT

(75) Inventor: Katsunori Yamazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 340 days.

(21) Appl. No.: 10/178,590

(22) Filed: Jun. 25, 2002

(65) Prior Publication Data

US 2003/0011583 A1 Jan. 16, 2003

(30) Foreign Application Priority Data

Jun. 26, 2001 (JP) ..... 2001-192775
Apr. 10, 2002 (JP) ..... 2002-108533

(51) Int. Cl.
*G09G 5/00* (2006.01)

(52) U.S. Cl. ..... 345/204; 345/96; 345/100

(58) Field of Classification Search ..... 345/204, 345/89, 96, 99, 100, 103, 209, 87, 88, 90, 345/91, 92, 93, 98, 205
See application file for complete search history.

(56) References Cited

U.S. PATENT DOCUMENTS 5,818,409 A * 10/1998 Furuhashi et al. ..... 345/94
6,118,425 A * 9/2000 Kudo et al. ..... 345/100
6,172,662 B1 * 1/2001 Ito et al. ..... 345/94
6,307,681 B1 * 10/2001 Aoki et al. ..... 359/645
6,545,653 B1 * 4/2003 Takahara et al. ..... 345/87
6,583,778 B1 * 6/2003 Nishimura et al. ..... 345/96
6,636,206 B1 * 10/2003 Yatabe ..... 345/204

* cited by examiner

*Primary Examiner*—Richard Hjerpe
*Assistant Examiner*—Jean Lesperance
(74) *Attorney, Agent, or Firm*—Oliff & Berridge, PLC

(57) ABSTRACT

The present invention provides a drive circuit of a display device that reduces power consumption while restraining the occurrence of cross talk at the same time. The drive circuit can include a plurality of scanning lines that are bundled into a block, and the polarities of the selection voltages of scanning signals Yi, Yi+1, Yi+2, and Yi+3 supplied to the scanning lines that belong to the same block are alternately inverted. Furthermore, the polarity of the selection voltage of the scanning signal Yi+3 supplied to the scanning line selected last in the block is the same as the polarity of the selection voltage of the scanning signal Yi+4 supplied to the scanning line selected first in a block following the aforesaid block. Accordingly, it is possible to reduce power consumption while restraining the degradation in display quality at the same time.

20 Claims, 33 Drawing Sheets

<POLARITIES OF SELECTION VOLTAGES>

FRAME →

| | | 1 | ① 2 | ② 3 | 4 | 5 | 6 | 7 | 8 | 9 | 10 | 11 | 12 | 13 |
|---|---|---|---|---|---|---|---|---|---|---|---|---|---|---|
| BLOCK | 1ST LINE | + | − | + | − | + | − | + | − | + | − | + | − | + |
| | 2ND LINE | − | + | − | + | − | + | − | + | − | + | − | + | − |
| | 3RD LINE | + | − | + | − | + | − | + | − | + | − | + | − | + |
| | 4TH LINE | − | + | − | + | − | + | − | + | − | + | − | + | − |
| BLOCK | 5TH LINE | − | + | − | + | − | + | − | + | − | + | − | + | − |
| | 6TH LINE | + | − | + | − | + | − | + | − | + | − | + | − | + |
| | 7TH LINE | − | + | − | + | − | + | − | + | − | + | − | + | − |
| | 8TH LINE | + | − | + | − | + | − | + | − | + | − | + | − | + |
| | 9TH LINE | + | − | + | − | + | − | + | − | + | − | + | − | + |
| | 10TH LINE | − | + | − | + | − | + | − | + | − | + | − | + | − |
| | 11TH LINE | + | − | + | − | + | − | + | − | + | − | + | − | + |
| | 12TH LINE | − | + | − | + | − | + | − | + | − | + | − | + | − |
| | 13TH LINE | − | + | − | + | − | + | − | + | − | + | − | + | − |
| | 14TH LINE | + | − | + | − | + | − | + | − | + | − | + | − | + |
| | 15TH LINE | − | + | − | + | − | + | − | + | − | + | − | + | − |
| | 16TH LINE | + | − | + | − | + | − | + | − | + | − | + | − | + |
| | 17TH LINE | + | − | + | − | + | − | + | − | + | − | + | − | + |
| | 18TH LINE | − | + | − | + | − | + | − | + | − | + | − | + | − |
| | 19TH LINE | + | − | + | − | + | − | + | − | + | − | + | − | + |
| | 20TH LINE | − | + | − | + | − | + | − | + | − | + | − | + | − |
| | 21ST LINE | − | + | − | + | − | + | − | + | − | + | − | + | − |
| | 22ND LINE | + | − | + | − | + | − | + | − | + | − | + | − | + |
| | 23RD LINE | − | + | − | + | − | + | − | + | − | + | − | + | − |
| | 24TH LINE | + | − | + | − | + | − | + | − | + | − | + | − | + |
| | 25TH LINE | + | − | + | − | + | − | + | − | + | − | + | − | + |
| | 26TH LINE | − | + | − | + | − | + | − | + | − | + | − | + | − |
| | 27TH LINE | + | − | + | − | + | − | + | − | + | − | + | − | + |
| | 28TH LINE | − | + | − | + | − | + | − | + | − | + | − | + | − |
| | 29TH LINE | − | + | − | + | − | + | − | + | − | + | − | + | − |
| | 30TH LINE | + | − | + | − | + | − | + | − | + | − | + | − | + |
| | 31ST LINE | − | + | − | + | − | + | − | + | − | + | − | + | − |
| | 32ND LINE | + | − | + | − | + | − | + | − | + | − | + | − | + |
| | 33RD LINE | + | − | + | − | + | − | + | − | + | − | + | − | + |

↓ SCANNING LINES

FIG. 8

<POLARITIES OF SELECTION VOLTAGES>

FRAME →

| | | 1 | 2 | 3 | 4 | 5 | 6 | 7 | 8 | 9 | 10 | 11 | 12 | 13 |
|---|---|---|---|---|---|---|---|---|---|---|---|---|---|---|
| 5 | 1ST LINE | + | − | + | − | + | − | + | − | + | − | + | − | + |
| | 2ND LINE | − | + | − | + | − | + | − | + | − | + | − | + | − |
| | 3RD LINE | + | − | + | − | + | − | + | − | + | − | + | − | + |
| | 4TH LINE | − | + | − | + | − | + | − | + | − | + | − | + | − |
| | 5TH LINE | + | − | + | − | + | − | + | − | + | − | + | − | + |
| 4 | 6TH LINE | + | − | + | − | + | − | + | − | + | − | + | − | + |
| | 7TH LINE | − | + | − | + | − | + | − | + | − | + | − | + | − |
| | 8TH LINE | + | − | + | − | + | − | + | − | + | − | + | − | + |
| | 9TH LINE | − | + | − | + | − | + | − | + | − | + | − | + | − |
| 7 | 10TH LINE | − | + | − | + | − | + | − | + | − | + | − | + | − |
| | 11TH LINE | + | − | + | − | + | − | + | − | + | − | + | − | + |
| | 12TH LINE | − | + | − | + | − | + | − | + | − | + | − | + | − |
| | 13TH LINE | + | − | + | − | + | − | + | − | + | − | + | − | + |
| | 14TH LINE | − | + | − | + | − | + | − | + | − | + | − | + | − |
| | 15TH LINE | + | − | + | − | + | − | + | − | + | − | + | − | + |
| | 16TH LINE | − | + | − | + | − | + | − | + | − | + | − | + | − |
| | 17TH LINE | − | + | − | + | − | + | − | + | − | + | − | + | − |
| | 18TH LINE | + | − | + | − | + | − | + | − | + | − | + | − | + |
| | 19TH LINE | − | + | − | + | − | + | − | + | − | + | − | + | − |
| | 20TH LINE | + | − | + | − | + | − | + | − | + | − | + | − | + |
| | 21ST LINE | − | + | − | + | − | + | − | + | − | + | − | + | − |
| | 22ND LINE | − | + | − | + | − | + | − | + | − | + | − | + | − |
| | 23RD LINE | + | − | + | − | + | − | + | − | + | − | + | − | + |
| | 24TH LINE | − | + | − | + | − | + | − | + | − | + | − | + | − |
| | 25TH LINE | + | − | + | − | + | − | + | − | + | − | + | − | + |
| | 26TH LINE | + | − | + | − | + | − | + | − | + | − | + | − | + |
| | 27TH LINE | − | + | − | + | − | + | − | + | − | + | − | + | − |
| | 28TH LINE | + | − | + | − | + | − | + | − | + | − | + | − | + |
| | 29TH LINE | − | + | − | + | − | + | − | + | − | + | − | + | − |
| | 30TH LINE | + | − | + | − | + | − | + | − | + | − | + | − | + |
| | 31ST LINE | − | + | − | + | − | + | − | + | − | + | − | + | − |
| | 32ND LINE | + | − | + | − | + | − | + | − | + | − | + | − | + |
| | 33RD LINE | + | − | + | − | + | − | + | − | + | − | + | − | + |

↓ SCANNING LINES

FIG. 19

<POLARITIES OF SELECTION VOLTAGES>

FRAME →

| SCANNING LINES ↓ | 1 | 2 | 3 | 4 | 5 | 6 | 7 | 8 | 9 | 10 | 11 | 12 | 13 |
|---|---|---|---|---|---|---|---|---|---|---|---|---|---|
| 1ST LINE | + | + | − | + | − | − | + | − | + | + | − | + | − |
| 2ND LINE | − | + | + | − | + | − | − | + | − | + | + | − | + |
| 3RD LINE | + | − | + | + | − | + | − | − | + | − | + | + | − |
| 4TH LINE | − | + | − | + | + | − | + | − | − | + | − | + | + |
| 5TH LINE | − | − | + | − | + | + | − | + | − | − | + | − | + |
| 6TH LINE | + | − | − | + | − | + | + | − | + | − | − | + | − |
| 7TH LINE | − | + | − | − | + | − | + | + | − | + | − | − | + |
| 8TH LINE | + | − | + | − | − | + | − | + | + | − | + | − | − |
| 9TH LINE | + | + | − | + | − | − | + | − | + | + | − | + | − |
| 10TH LINE | − | + | + | − | + | − | − | + | − | + | + | − | + |
| 11TH LINE | + | − | + | + | − | + | − | − | + | − | + | + | − |
| 12TH LINE | − | + | − | + | + | − | + | − | − | + | − | + | + |
| 13TH LINE | − | − | + | − | + | + | − | + | − | − | + | − | + |
| 14TH LINE | + | − | − | + | − | + | + | − | + | − | − | + | − |
| 15TH LINE | − | + | − | − | + | − | + | + | − | + | − | − | + |
| 16TH LINE | + | − | + | − | − | + | − | + | + | − | + | − | − |
| 17TH LINE | + | + | − | + | − | − | + | − | + | + | − | + | − |
| 18TH LINE | − | + | + | − | + | − | − | + | − | + | + | − | + |
| 19TH LINE | + | − | + | + | − | + | − | − | + | − | + | + | − |
| 20TH LINE | − | + | − | + | + | − | + | − | − | + | − | + | + |
| 21ST LINE | − | − | + | − | + | + | − | + | − | − | + | − | + |
| 22ND LINE | + | − | − | + | − | + | + | − | + | − | − | + | − |
| 23RD LINE | − | + | − | − | + | − | + | + | − | + | − | − | + |
| 24TH LINE | + | − | + | − | − | + | − | + | + | − | + | − | − |
| 25TH LINE | + | + | − | + | − | − | + | − | + | + | − | + | − |
| 26TH LINE | − | + | + | − | + | − | − | + | − | + | + | − | + |
| 27TH LINE | + | − | + | + | − | + | − | − | + | − | + | + | − |
| 28TH LINE | − | + | − | + | + | − | + | − | − | + | − | + | + |
| 29TH LINE | − | − | + | − | + | + | − | + | − | − | + | − | + |
| 30TH LINE | + | − | − | + | − | + | + | − | + | − | − | + | − |
| 31ST LINE | − | + | − | − | + | − | + | + | − | + | − | − | + |
| 32ND LINE | + | − | + | − | − | + | − | + | + | − | + | − | − |
| 33RD LINE | + | + | − | + | − | − | + | − | + | + | − | + | − |

FIG. 20

<POLARITIES OF SELECTION VOLTAGES>

③ ④

FRAME →

| SCANNING LINES ↓ | 1 | 2 | 3 | 4 | 5 | 6 | 7 | 8 | 9 | 10 | 11 | 12 | 13 |
|---|---|---|---|---|---|---|---|---|---|---|---|---|---|
| 1ST LINE | ⊕ | + | − | + | ⊖ | − | + | − | ⊕ | + | − | + | − |
| 2ND LINE | − | ⊕ | + | − | + | ⊖ | − | + | − | ⊕ | + | − | + |
| 3RD LINE | + | − | ⊕ | + | − | + | ⊖ | − | + | − | ⊕ | + | − |
| 4TH LINE | − | + | − | ⊕ | + | − | + | ⊖ | − | + | − | ⊕ | + |
| 5TH LINE | ⊖ | − | + | − | ⊕ | + | − | + | ⊖ | − | + | − | ⊕ |
| 6TH LINE | + | ⊖ | − | + | − | ⊕ | + | − | + | ⊖ | − | + | − |
| 7TH LINE | − | + | ⊖ | − | + | − | ⊕ | + | − | + | ⊖ | − | + |
| 8TH LINE | + | − | + | ⊖ | − | + | − | ⊕ | + | − | + | ⊖ | − |
| 9TH LINE | ⊕ | + | − | + | ⊖ | − | + | − | ⊕ | + | − | + | ⊖ |
| 10TH LINE | − | ⊕ | + | − | + | ⊖ | − | + | − | ⊕ | + | − | + |
| 11TH LINE | + | − | ⊕ | + | − | + | ⊖ | − | + | − | ⊕ | + | − |
| 12TH LINE | − | + | − | ⊕ | + | − | + | ⊖ | − | + | − | ⊕ | + |
| 13TH LINE | ⊖ | − | + | − | ⊕ | + | − | + | ⊖ | − | + | − | ⊕ |
| 14TH LINE | + | ⊖ | − | + | − | ⊕ | + | − | + | ⊖ | − | + | − |
| 15TH LINE | − | + | ⊖ | − | + | − | ⊕ | + | − | + | ⊖ | − | + |
| 16TH LINE | + | − | + | ⊖ | − | + | − | ⊕ | + | − | + | ⊖ | − |
| 17TH LINE | ⊕ | + | − | + | ⊖ | − | + | − | ⊕ | + | − | + | ⊖ |
| 18TH LINE | − | ⊕ | + | − | + | ⊖ | − | + | − | ⊕ | + | − | + |
| 19TH LINE | + | − | ⊕ | + | − | + | ⊖ | − | + | − | ⊕ | + | − |
| 20TH LINE | − | + | − | ⊕ | + | − | + | ⊖ | − | + | − | ⊕ | + |
| 21ST LINE | ⊖ | − | + | − | ⊕ | + | − | + | ⊖ | − | + | − | ⊕ |
| 22ND LINE | + | ⊖ | − | + | − | ⊕ | + | − | + | ⊖ | − | + | − |
| 23RD LINE | − | + | ⊖ | − | + | − | ⊕ | + | − | + | ⊖ | − | + |
| 24TH LINE | + | − | + | ⊖ | − | + | − | ⊕ | + | − | + | ⊖ | − |
| 25TH LINE | ⊕ | + | − | + | ⊖ | − | + | − | ⊕ | + | − | + | ⊖ |
| 26TH LINE | − | ⊕ | + | − | + | ⊖ | − | + | − | ⊕ | + | − | + |
| 27TH LINE | + | − | ⊕ | + | − | + | ⊖ | − | + | − | ⊕ | + | − |
| 28TH LINE | − | + | − | ⊕ | + | − | + | ⊖ | − | + | − | ⊕ | + |
| 29TH LINE | ⊖ | − | + | − | ⊕ | + | − | + | ⊖ | − | + | − | ⊕ |
| 30TH LINE | + | ⊖ | − | + | − | ⊕ | + | − | + | ⊖ | − | + | − |
| 31ST LINE | − | + | ⊖ | − | + | − | ⊕ | + | − | + | ⊖ | − | + |
| 32ND LINE | + | − | + | ⊖ | − | + | − | ⊕ | + | − | + | ⊖ | − |
| 33RD LINE | ⊕ | + | − | + | ⊖ | − | + | − | ⊕ | + | − | + | ⊖ |

FIG. 21

<POLARITIES OF SELECTION VOLTAGES>

FRAME →

| SCANNING LINES ↓ | 1 | 2 | 3 | 4 | 5 | 6 | 7 | 8 | 9 | 10 | 11 | 12 | 13 |
|---|---|---|---|---|---|---|---|---|---|---|---|---|---|
| 1ST LINE | + | ⊕ | − | + | − | ⊖ | + | − | + | ⊕ | − | + | − |
| 2ND LINE | − | + | ⊕ | − | + | − | ⊖ | + | − | + | ⊕ | − | + |
| 3RD LINE | + | − | + | ⊕ | − | + | − | ⊖ | + | − | + | ⊕ | − |
| 4TH LINE | ⊖ | + | − | + | ⊕ | − | + | − | ⊖ | + | − | + | ⊕ |
| 5TH LINE | − | ⊖ | + | − | + | ⊕ | − | + | − | ⊖ | + | − | + |
| 6TH LINE | + | − | ⊖ | + | − | + | ⊕ | − | + | − | ⊖ | + | − |
| 7TH LINE | − | + | − | ⊖ | + | − | + | ⊕ | − | + | − | ⊖ | + |
| 8TH LINE | ⊕ | − | + | − | ⊖ | + | − | + | ⊕ | − | + | − | ⊖ |
| 9TH LINE | + | ⊕ | − | + | − | ⊖ | + | − | + | ⊕ | − | + | − |
| 10TH LINE | − | + | ⊕ | − | + | − | ⊖ | + | − | + | ⊕ | − | + |
| 11TH LINE | + | − | + | ⊕ | − | + | − | ⊖ | + | − | + | ⊕ | − |
| 12TH LINE | ⊖ | + | − | + | ⊕ | − | + | − | ⊖ | + | − | + | ⊕ |
| 13TH LINE | − | ⊖ | + | − | + | ⊕ | − | + | − | ⊖ | + | − | + |
| 14TH LINE | + | − | ⊖ | + | − | + | ⊕ | − | + | − | ⊖ | + | − |
| 15TH LINE | − | + | − | ⊖ | + | − | + | ⊕ | − | + | − | ⊖ | + |
| 16TH LINE | ⊕ | − | + | − | ⊖ | + | − | + | ⊕ | − | + | − | ⊖ |
| 17TH LINE | + | ⊕ | − | + | − | ⊖ | + | − | + | ⊕ | − | + | − |
| 18TH LINE | − | + | ⊕ | − | + | − | ⊖ | + | − | + | ⊕ | − | + |
| 19TH LINE | + | − | + | ⊕ | − | + | − | ⊖ | + | − | + | ⊕ | − |
| 20TH LINE | ⊖ | + | − | + | ⊕ | − | + | − | ⊖ | + | − | + | ⊕ |
| 21ST LINE | − | ⊖ | + | − | + | ⊕ | − | + | − | ⊖ | + | − | + |
| 22ND LINE | + | − | ⊖ | + | − | + | ⊕ | − | + | − | ⊖ | + | − |
| 23RD LINE | − | + | − | ⊖ | + | − | + | ⊕ | − | + | − | ⊖ | + |
| 24TH LINE | ⊕ | − | + | − | ⊖ | + | − | + | ⊕ | − | + | − | ⊖ |
| 25TH LINE | + | ⊕ | − | + | − | ⊖ | + | − | + | ⊕ | − | + | − |
| 26TH LINE | − | + | ⊕ | − | + | − | ⊖ | + | − | + | ⊕ | − | + |
| 27TH LINE | + | − | + | ⊕ | − | + | − | ⊖ | + | − | + | ⊕ | − |
| 28TH LINE | ⊖ | + | − | + | ⊕ | − | + | − | ⊖ | + | − | + | ⊕ |
| 29TH LINE | − | ⊖ | + | − | + | ⊕ | − | + | − | ⊖ | + | − | + |
| 30TH LINE | + | − | ⊖ | + | − | + | ⊕ | − | + | − | ⊖ | + | − |
| 31ST LINE | − | + | − | ⊖ | + | − | + | ⊕ | − | + | − | ⊖ | + |
| 32ND LINE | ⊕ | − | + | − | ⊖ | + | − | + | ⊕ | − | + | − | ⊖ |
| 33RD LINE | + | ⊕ | − | + | − | ⊖ | + | − | + | ⊕ | − | + | − |

FIG. 24

DISPLAY DEVICE, DRIVE CIRCUIT THEREOF, DRIVING METHOD THEREFOR, AND ELECTRONIC EQUIPMENT

BACKGROUND OF THE INVENTION

1. Field of Invention

The present invention relates to a display device, a drive circuit thereof, and a driving method therefor. The invention further relates to electronic equipment that achieve reduced power consumption while restraining degradation in display quality in, for example, device where the switching of pixels is performed by a thin film diode.

2. Description of Related Art

Currently, display units making use of electro-optical changes of liquid crystals are being extensively used with a variety of electronic equipment, such as televisions, and the like, as display devices that replace cathode ray tubes (CRT) by taking advantage of their features, such as thin compact designs and lower power consumption.

The display devices may be roughly divided on the basis of a driving system or the like into an active matrix type in which pixels are driven by switching and a passive matrix type in which pixels are driven without using switching elements. Of these, the active matrix type may be further roughly divided on the basis of the type of switching elements into a type that uses three-terminal switching elements, such as thin film transistors (TFTs), and a type that uses two-terminal type switching elements, such as thin film diodes (TFDs). The two-terminal type switching elements are considered to be advantageous in that a problem of short-circuit among wires does not theoretically occur because of the absence of intersections of wires. Accordingly, a film forming process and a photolithography process can be shortened, and the switching element is suited for achieving lower power consumption.

Meanwhile, in a display device in which pixels are switched by the two-terminal type switching elements, various modes that can lead to degraded display quality exist. However, it is known that such degradation problem of display quality can be solved by using a four-value driving method (½H, 1H inversion) in which the ratio of a period during which two voltages that a data line (segment electrode) may take are applied is lastly halved regardless of a pattern to be displayed.

Especially in portable electronic equipment, such as a PDA (Personal Digital Assistant) and a cellular telephone, that are mainly battery-driven, so that there is a high demand that they consume less power. For this reason, there has been accordingly high demand for lower power consumption in the display devices of portable electronic equipment.

Furthermore, diverse functions, including the reproduction of music, have been added to such a type of portable electronic equipment, and there has even been a demand for reducing the power consumption of the display device even if it is just 1 mW in order to secure electric power applied to such additional functions.

On the other hand, in recent years, display devices have been required to provide higher gray scale display for performing display with more intermediate gray scales in addition to simple monochromic display.

SUMMARY OF THE INVENTION

However, performing the intermediate gray scale display in the above four-value driving method inevitably leads to a higher voltage switching frequency of data lines, thus posing a shortcoming in that electric power is wasted due to capacitance accompanying the data lines. On the other hand, if the four-value driving method (½H selection, 1H inversion) is not used, then a problem occurs in which display quality is deteriorated, depending upon a mode.

The present invention has been made in view of the above, and an object of the present invention is to provide a display device, a drive circuit thereof, a driving method therefor, and electronic equipment that achieves reduced power consumption while restraining degradation in display quality.

To this end, a drive circuit of a display device according to an embodiment of the present invention is a drive circuit of a display device for driving pixels provided in correspondence with the intersections of scanning lines and data lines. The drive circuit can include a construction equipped with a scanning line drive circuit that selects the scanning lines on a one-by-one basis, and applies a selection voltage to the selected scanning line, while the scanning line drive circuit applies a non-selection voltage to all other scanning lines. A plurality of the scanning lines can be bundled into a block, the polarity of the selection voltage being reversed each time one scanning line is selected on the basis of an intermediate value of an ON voltage and an OFF voltage applied to the data lines in one block, and a selection voltage of a scanning line lastly selected in a block can be set to the same polarity as that of a selection voltage of a scanning line firstly selected in a block following the aforesaid block. Further, a data line drive circuit that, when a scanning line is selected and the selection voltage is applied thereto, can apply the ON voltage or the OFF voltage to a data line on the basis of information to be displayed by a pixel associated with an intersection of the scanning line and the data line and the polarity of the selection voltage.

According to this construction, even when an ON pixel and an OFF pixel alternately appear in a data line, there will be a smaller difference between the effective value of a voltage applied to the data line and the effective value of a voltage applied to other data lines, making it possible to restrain the degradation in display quality.

Furthermore, even when pixels of intermediate gray scales successively appear in a data line, there will be less frequent switching of a data voltage applied to the data line, so that the electric power wastefully consumed due to charging and discharging of a capacitance accompanying the data line or its drive circuit is restrained, thus permitting reduced power consumption accordingly.

The ON voltage in this case refers to a data signal voltage that has an opposite polarity to a selection voltage applied during a period in which a certain scanning line has been selected, while the OFF voltage refers to a data signal voltage that has the same polarity as a selection voltage applied during a period in which a certain scanning line has been also selected.

According to the above construction, even when an ON pixel and an OFF pixel alternately appear in a data line, a bias will not occur in the effective value of voltage of the data line. However, the bias may take place, depending upon a display pattern. For instance, a bias occurs in the effective value of voltage of a data line if the ON pixels and the OFF pixels are arranged in correspondence with the polarities of the selection voltages in a block.

Preferably, therefore, in the above construction, the number of the scanning lines constituting the aforesaid block is different from the number of the scanning lines constituting a block following the aforesaid block. This construction lowers the appearance ratio of patterns that cause the bias to take place, allowing the degradation in display quality to be further restrained.

In the above drive circuit, unlike in other portions, the polarity of a selection voltage is the same in a scanning line corresponding to a boundary of a block, so that differences in display tend to occur. Preferably, therefore, in the above construction, the data line drive circuit corrects the ON voltage or the OFF voltage at least when the selection voltage is applied to the scanning line firstly selected in a block or when the selection voltage is applied to the scanning line lastly selected in a block. With this construction, the differences in display can be reduced by correcting the ON voltage or the OFF voltage.

In addition to the correction made by the data line drive circuit to reduce the differences in display, the correction can be also made by the scanning line drive circuit. To be more specific, the scanning line drive circuit is preferably configured such that, at least when a selection voltage is applied to the scanning line selected first in a block or when a selection voltage is applied to the scanning line selected last in a block, the selection voltage or the application time of the selection voltage is corrected. With this arrangement, the differences in display can be reduced by correcting the selection voltage itself or the time for which the selection voltage is applied.

Meanwhile, the scanning line drive circuit can also preferably constructed to form the scanning lines into blocks so as to cause the boundary of the blocks to be sequentially shifted for each vertical scanning period. According to this construction, the boundary portion of blocks moves with the elapse of time, so that even if a display difference takes place in the portion, the display difference will not stand out, thus making it difficult to visually recognized it as the degradation in display quality.

In the construction wherein the boundary of blocks is sequentially shifted, the scanning line drive circuit may apply the non-selection voltage in place of the selection voltage to the scanning line selected firstly or lastly in a block. This causes writing to the boundary portion of the blocks to be skipped, so that the occurrence of a display difference can be restrained.

Similarly, the occurrence of a display difference can be restrained alternatively by correcting the ON voltage or the OFF voltage by the data line drive circuit when the selection voltage is applied to the scanning line selected firstly or lastly in a block.

Further alternatively, the occurrence of a display difference can also be restrained by correcting a selection voltage or the application time of the selection voltage by the scanning line drive circuit at least when the selection voltage is applied to the scanning line firstly selected in a block or when the selection voltage is applied to the scanning line lastly selected in a block.

The present invention can be also implemented in the form of a driving method for a display device. More specifically, the driving method can be a driving method for a display device for driving pixels provided in correspondence with the intersections of scanning lines and data lines. The scanning lines can be selected on a one-by-one basis, and a selection voltage can be applied to the selected scanning line, while a non-selection voltage is applied to all other scanning lines. A plurality of the scanning lines are bundled into a block, and the polarity of the selection voltage can be reversed each time one scanning line is selected on the basis of an intermediate value of an ON voltage and an OFF voltage applied to the data lines in one block. Further, a selection voltage of a scanning line lastly selected in one block can be set to the same polarity as that of a selection voltage of a scanning line firstly selected in a block following the aforesaid block. When a scanning line is selected and the selection voltage is applied thereto, the ON voltage or the OFF voltage can be applied to a data line on the basis of information to be displayed by a pixel associated with the intersection of the scanning line and the data line and the polarity of the selection voltage.

According to this method, there will be a smaller difference between the effective value of a voltage applied to a data line and the effective value of a voltage applied to other data lines, and the switching frequency of a data voltage applied to the data line will be lower. Hence, it is possible to reduce power consumption while restraining the degradation in display quality at the same time.

In addition, in order to attain the aforesaid object, a display device in accordance with the present invention can ■ characterized by a construction equipped with a drive circuit of a display device for driving pixels provided in correspondence with the intersections of scanning lines and data lines. The drive circuit can include a scanning line drive circuit that selects the scanning lines on a one-by-one basis, and applies a selection voltage to the selected scanning line, while it applies a non-selection voltage to all other scanning lines. A plurality of the scanning lines can be bundled into a block, the polarity of the selection voltage being reversed each time one scanning line is selected on the basis of an intermediate value of an ON voltage and an OFF voltage applied to the data lines in a block. The scanning line drive circuit setting the selection voltage of the scanning line selected last in a block and the selection voltage of the scanning line selected first in a block following the aforesaid block to the same polarity; and a data line drive circuit that, when a scanning line is selected and the selection voltage is applied thereto, applies the ON voltage or the OFF voltage to a data line on the basis of information to be displayed by a pixel associated with an intersection of the scanning line and the data line and the polarity of the selection voltage.

According to the display device, as in the case of the above drive circuit, the difference between the effective value of a voltage applied to a data line and the effective value of a voltage applied to other data lines is smaller, and the switching frequency of a data voltage applied to the data line is also low. It is therefore possible to achieve reduced power consumption while restraining the degradation in display quality at the same time.

Preferably, the display device in accordance with the present invention has a plurality of scanning lines, a plurality of data lines, and a plurality of pixels provided in correspondence with the intersections of the scanning lines and the data lines. Each of the pixels includes a pixel electrode and a two-terminal type switching element provided between the pixel electrode and the data line, and an electrically conductive portion that is electrically isolated from the pixel electrode is present between itself and the pixel electrode that is adjacent thereto in a direction in which the data lines extend.

According to the display device, the electrically conductive portion provided between adjacent pixel electrodes functions as an electrostatic shield for reducing a parasitic capacitance between these pixel electrodes, thus restraining the occurrence of uneven display in a block boundary portion. The electrically conductive portion may be a projecting portion formed by projecting a part of a data line in a different direction from the direction in which the data line extends. If a plurality of electrically conductive lines that are electrically isolated from the data line, extend in a different direction from the direction in which the data lines extend, and is respectively connected in common, then each of the electrically conductive lines corresponds to the electrically conductive portion.

In the display device according to the present invention, the pixel preferably includes a two-terminal type switching element having one end thereof connected to one of the scanning line and the data line, and an electro-optical capacitor having an electro-optical material sandwiched between the other one of scanning line and the data line and a pixel electrode connected to the other end of the two-terminal type switching element. Use of the two-terminal type switching element can provide advantages, including one in that a problem of short-circuit among wires does not theoretically arise and that the manufacturing process can be simplified, as compared with the construction using a three-terminal type switching element.

Furthermore, such a two-terminal type switching element can be preferably configured to have a structure in which an insulating member is sandwiched by electrically conductive members. This construction allows either of the electrically conductive members to be used directly as a scanning line or a data line, and the insulating member to be formed by oxidizing the electrically conductive member itself.

Electronic equipment according to the present invention is equipped with the aforesaid display device, thus permitting reduced power consumption or the like to be achieved, while restraining the degradation in display quality. Such electronic equipment includes a personal computer, a cellular telephone, a digital still camera and the like.

BRIEF DESCRIPTION OF THE DRAWINGS

The invention will be described with reference to the accompanying drawings wherein like numerals reference like elements, and wherein:

FIG. 8 is a timetable showing the polarities of selection voltages applied to individual lines in the display device;

FIG. 19 is a timetable showing the polarities of selection voltages applied to individual lines in a display device according to an application example of the present invention;

FIG. 20 is a timetable showing the polarities of selection voltages applied to individual lines in a display device according to an application example of the present invention;

FIG. 21 is a timetable showing the polarities, etc. of selection voltages applied to individual lines in a display device according to an application example of the present invention;

FIG. 24 is a timetable showing the polarities, etc. of selection voltages applied to individual lines in a display device according to an application example of the present invention;

DETAILED DESCRIPTION OF PREFERRED EMBODIMENTS

An embodiment of the present invention will now be explained with reference to the accompanying drawings.

Figure 1:
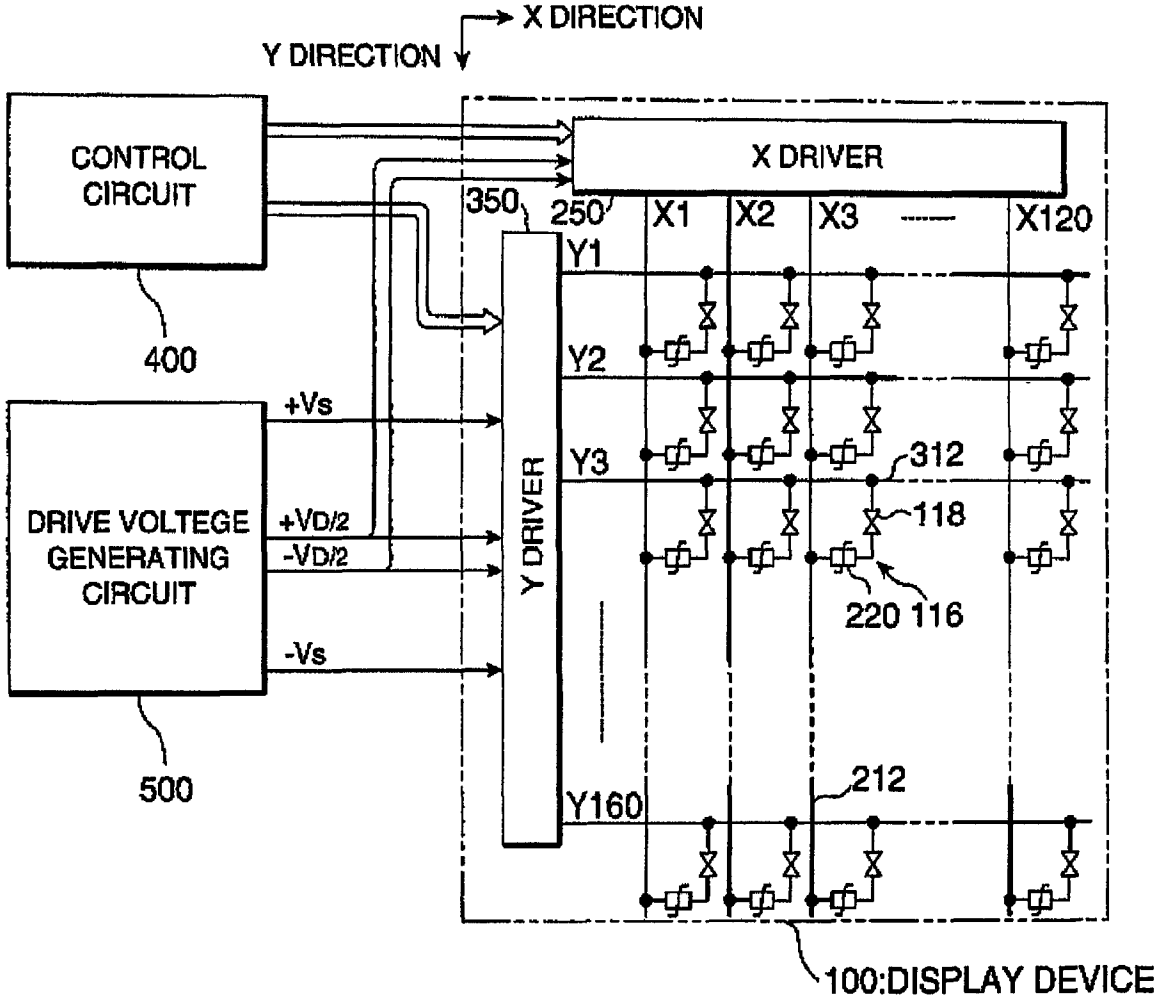
FIG. 1 is a block diagram showing an electrical construction of a display device according to an embodiment of the present invention.

First, an electrical construction of the display device in accordance with the embodiment of the present invention will be explained. FIG. 1 is an exemplary block diagram showing the construction.

As shown in the diagram, in a display device 100, a plurality of data lines (segment electrodes) 212 are formed such that they extend in a column (Y) direction, while a plurality of scanning lines (common electrodes) 312 are formed such that they extend in a line (X) direction, and pixels 116 are formed for the individual intersections of the data lines 212 and the scanning lines 312. Furthermore, each of the individual pixels 116 can be formed of a liquid crystal capacitor 118 and a TFD (Thin Film Diode) 220, which is an example of a two-terminal type switching element, that are connected in series. Of these, the liquid crystal capacitor 118 is constructed such that a liquid crystal, which is an example of an electro-optical material, can be sandwiched between a pixel electrode and the scanning line 312 functioning as an opposing electrode, as it will be discussed in greater detail below.

In this embodiment, for the convenience of explanation, the total number of the scanning lines 312 is set to 160, and the total number of data lines 212 is set to 120 to make a matrix type display device of 160 lines times 120 columns, which will be described in greater detail below. It should be understood that the above is merely exemplary, and that the present invention is not intended to be limited thereto.

A Y driver 350 is generally referred to as a scanning line drive circuit, and supplies scanning signals Y1, Y2, Y3, . . . , Y160 to the scanning lines 312 of a first line, a second line, a third line, . . . , 160th line, respectively. To be more specific, the Y driver 350 selects the 160 scanning lines 312 on a one-by-one basis in the order which will be described later, and applies a selection voltage to a selected scanning line 312 and a non-selection voltage to other scanning lines 312, respectively.

An X driver 250 is generally referred to as a data line drive circuit, and supplies data signals X1, X2, X3, . . . , X120 through the associated data lines 212 on the basis of display contents to the pixels 116 positioned on the scanning lines 312 selected by the Y driver 350. The detailed constructions of the X driver 250 and the Y driver 350 will be discussed below.

Meanwhile, a control circuit 400 supplies gray scale data to be discussed later, a variety of control signals, clock signals, etc. to the X driver 250 and the Y driver 350 so as to control the two drivers. A drive voltage generating circuit 500 generates a voltage $\pm V_S$ and a voltage $\pm V_D/2$, respectively.

In this embodiment, the voltage $\pm V_S$ is configured to be used as a selection voltage in the scanning signals, and the voltage $\pm V_D/2$ is configured to be used as a non-selection voltage in the scanning signals and also as a data voltage in the data signals. The non-selection voltage and the data voltage may be different rather than the same. However, if they are different, then the number of voltages to be generated by the drive voltage generating circuit 500 increases, resulting in a more complicated configuration accordingly.

In this embodiment, the polarity reference of the voltage applied to the scanning lines 312 or the data lines 212 is based on the intermediate voltage (virtual voltage) of the data voltage $\pm V_D/2$ applied to the data lines 212. If the voltage is higher than the intermediate voltage, then the polarity is positive, and if the voltage is lower than that, then the polarity is negative.

Figure 2:
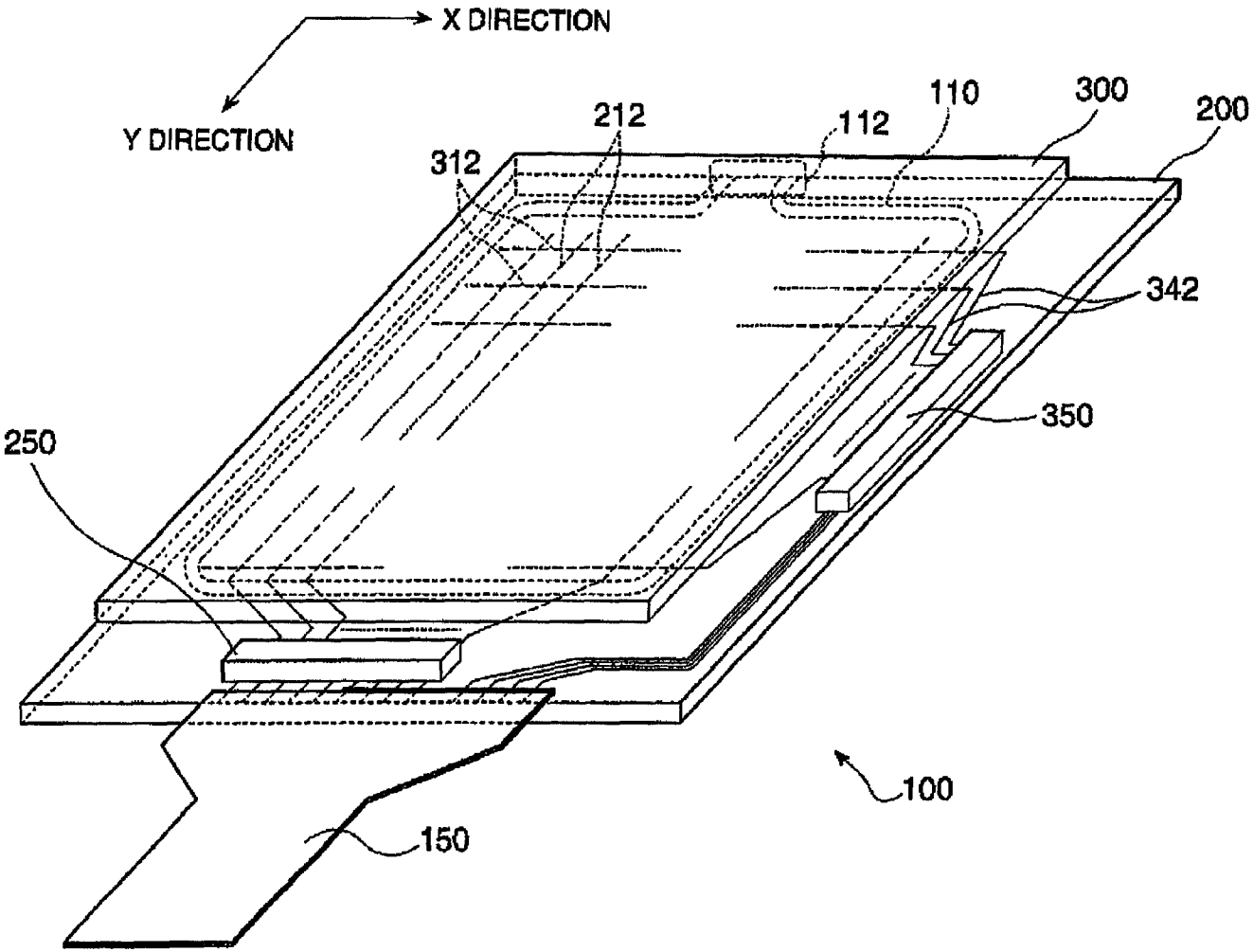
FIG. 2 is a perspective view showing the construction of the display device.
Figure 3:
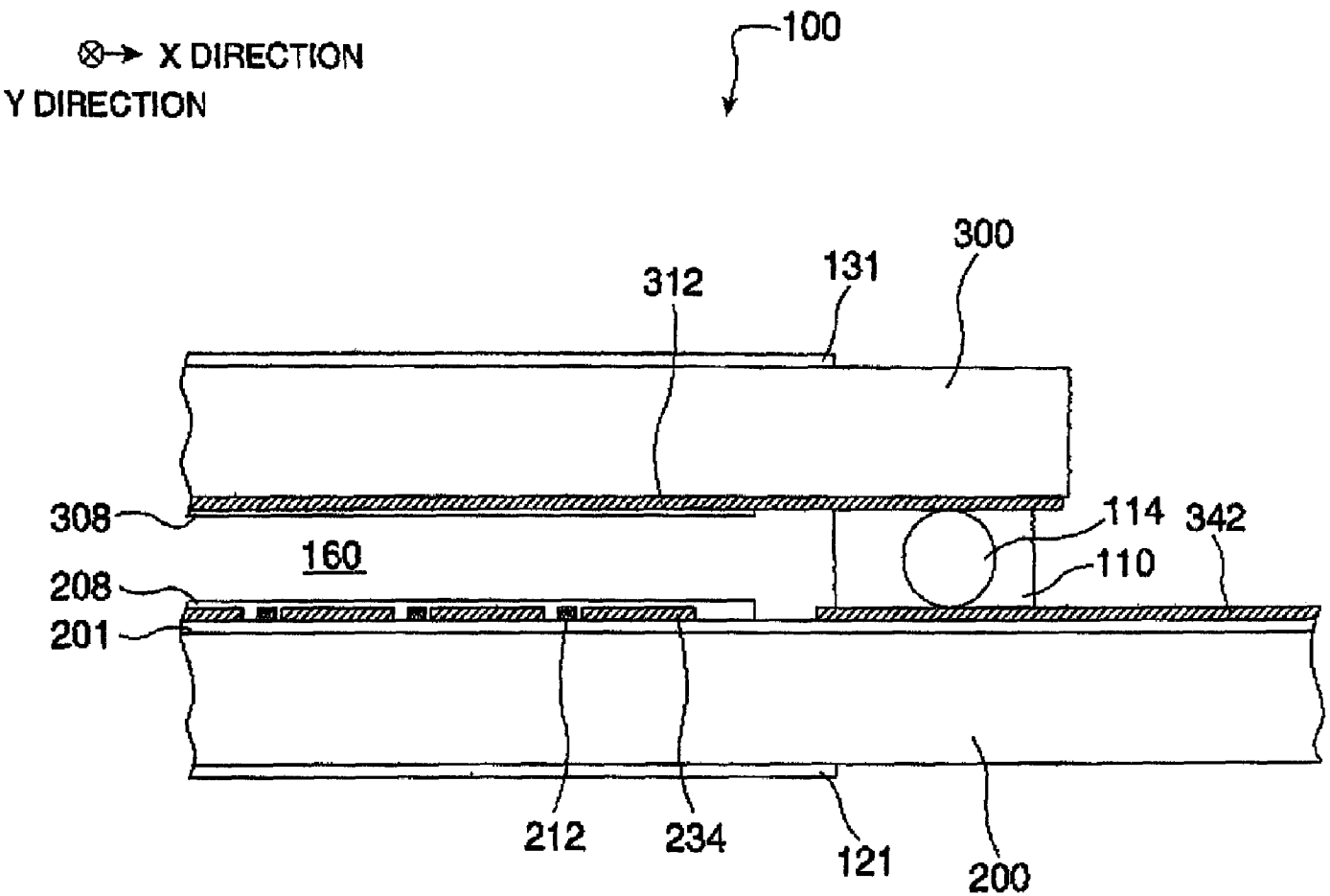
FIG. 3 is a partial sectional view showing the construction of the display device cut in an X direction.

A mechanical construction of the display device in accordance with the embodiment will now be explained. FIG. 2 is a perspective view showing an entire construction of the display device 100, and FIG. 3 is a partial sectional view showing a construction obtained by cutting the display device 100 in the X direction.

As shown in these diagrams, the display device 100 is constructed such that an opposing board 300 positioned on an observer side and an element board 200 located on the rear side thereof are bonded together with a predetermined gap maintained therebetween by a sealing member 110 which serves also as a spacer and in which electrically conductive particles (electrically conductive material) 114 mixed in. A TN (Twisted Nematic) type liquid crystal 160, for example, is sealed in the gap. As shown in FIG. 2, the sealing member 110 is formed into a frame shape along the inner peripheral edge of the opposing board 300, and is partly opened so as to inject the liquid crystal 160 therethrough. Hence, the opened portion is sealed by a sealer 112 after the liquid crystal is injected.

The opposing surface of the opposing board 300 has an oriented film 308 in addition to the scanning lines 312 formed to extend in the line (X) direction, and is provided with rubbing treatment in a predetermined direction. The scanning lines 312 formed on the opposing board 300 are connected to one end of wires 342 formed on the element board 200, the wires 342 corresponding to the scanning lines 312 on a one-to-one basis through the intermediary of the electrically conductive particles 114 dispersed in the sealing member 110, as shown in FIG. 3. In other words, the scanning lines 312 formed on the opposing board 300 are drawn out to the element board 200 through the intermediary of the electrically conductive particle 114 and the wires 342.

Meanwhile, a polarizer 131 (omitted in FIG. 2) is bonded to the outer side (observer side) of the opposing board 300, and its absorbing axis is set in association with the direction of the rubbing treatment on the oriented film 308.

The opposing surface of the element board 200 has an oriented film 208 in addition to a rectangular pixel electrode 234 formed adjacently to the data lines 212 formed to extend in the Y (column) direction, and has been provided with rubbing treatment in a predetermined direction. Meanwhile, a polarizer 121 (omitted in FIG. 2) is bonded to the outer side (on the opposite side to the observer side) of the element board 200, and its absorbing axis is set in association with the direction of the rubbing treatment on the oriented film 208. Outside the element board 200, a backlight unit for uniformly radiating light is provided, however, the backlight unit is not directly connected with this case, so that it is not shown.

The descriptions will now be given of the area outside a display region. As shown in FIG. 2, the X driver 250 for driving the data lines 212 and the Y driver 350 for driving the scanning lines 312 are respectively mounted by the COG (Chip On Glass) technology on two sides that are on the element board 200 and project from the opposing board 300. This allows the X driver 250 to directly supply data signals to the data lines 212 and the Y driver 350 to indirectly supply scanning signals to the scanning lines 312 through the intermediary of the wires 342 and the electrically conductive particle 114.

In the vicinity of the area outside the region wherein the X driver 250 is mounted, an FPC (Flexible Printed Circuit) board 150 is attached so as to supply a variety of signals, voltage signals, etc. by the control circuit 400 (refer to FIG. 1), etc. to the Y driver 350 and the X driver 250, respectively.

Unlike in FIG. 2, the X driver 250 and the Y driver 350 in FIG. 1 are positioned on the left side and the upper side, respectively, of the display device 100. This is, however, just for the convenience in explaining the electrical configuration. Alternatively, instead of mounting the X driver 250 and the Y driver 350, respectively, by the COG technology on the element board 200, a TCP (Tape Carrier Package) on which the drivers have been mounted may be electrically connected to an anisotropic conductive film by using, for example, TAB (Tape Automated Bonding) technology.

Figure 4:
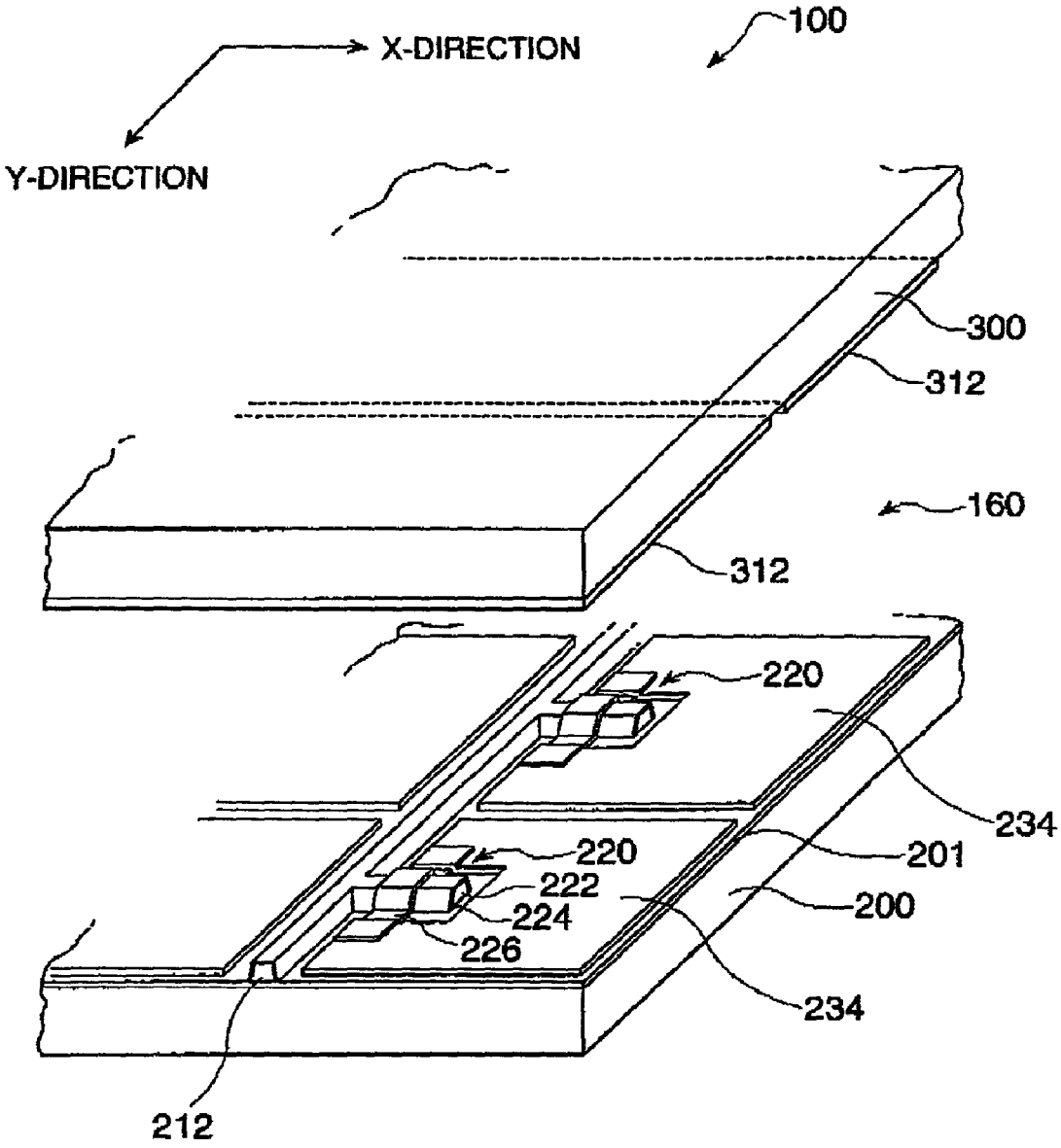
FIG. 4 is a partially cut-away perspective view showing the construction of an essential part of the display device.

The detailed configuration of the pixel 116 in the display device will now be explained. FIG. 4 is a partially cut-away perspective view showing the structure. In this drawing, for the purpose of understanding the explanation, the oriented films 208 and 308 and the polarizers 121 and 131 in FIG. 3 have been omitted.

As shown in FIG. 4, rectangular pixel electrodes 234 formed of transparent conductors, such as ITO (Indium Tin Oxide), are arranged in a matrix pattern on the opposing surface of the element board 200. Of them, the pixel electrodes 234 arranged in the same row are commonly connected to a single data line 212 through the intermediary of the TFDs 220. As observed from the board side, the TFD 220 is constituted by a first conductor 222 which is formed of an elementary substance of tantalum or a tantalum alloy or the like and which is branched from the data line 212 into a T shape, an insulator 224 formed by anodizing the first conductor 222, and a second conductor 226 formed of chromium or the like, thus forming a sandwich structure in which the insulator is sandwiched between the two conductors. Hence, the TFD 220 will have a diode switching characteristic represented by the current-voltage characteristic that is nonlinear in both positive and negative directions.

On the upper surface of the element board 200, a transparent insulating film 201 is formed as a base layer. To be more specific, the insulating film 201 is provided to prevent the first conductor 222 from peeling off due to the heat treatment after the deposition of the second conductor 226 and to prevent impurities from diffusing to the first conductor 222. Hence, if these do not pose a problem, then the insulating film 201 may be omitted.

Meanwhile, on the opposing surface of the opposing board 300, the scanning lines 312 formed of ITO or the like extend in the line direction orthogonal to the data lines 212 and are arranged at the position opposing the pixel electrodes 234. Thus, the scanning lines 312 function as the opposing electrodes of the pixel electrodes 234. Hence, the liquid crystal capacitor 118 in FIG. 1 is constructed by the scanning line 312, the pixel electrode 234, and the liquid crystal 160 sandwiched between the two at an intersection of the data line 212 and the scanning line 312.

In such a construction, regardless of the data voltage applied to the data lines 212, when the selection voltage that turns the TFD 220 ON is applied to the scanning line 312, the TFD 220 associated with the intersection of the scanning line 312 and the data line 212 turns ON, and the electric charges corresponding to the difference between the selection voltage and the data voltage are accumulated in the liquid crystal capacitor 118 connected to the TFD 220 that has turned ON. After the electric charges are accumulated, even if the non-selection voltage is applied to the scanning line 312 to turn the TFD 220 OFF, the electric charges accumulated at the liquid crystal capacitor 118 is maintained.

The alignment of the liquid crystal 160 changes according to the quantity of electric charges accumulated in the liquid crystal capacitor 118, so that the quantity of light passing through the polarizers 121 and 131 also changes according to the quantity of accumulated electric charges. Therefore, a predetermined gray scale display can be accomplished by controlling the quantity of electric charges accumulated at the liquid crystal capacitor 118 for each pixel on the basis of the data voltage at the time when the selection voltage is applied.

Figure 14:
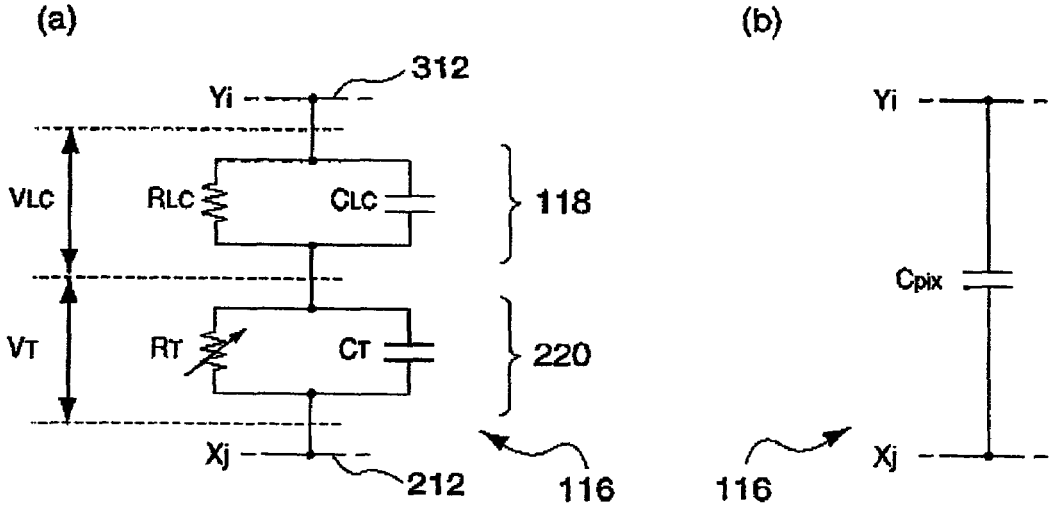
FIGS. 14 (*a*) and (*b*) are diagrams respectively showing equivalent circuits of pixels in the display device according to an embodiment.

Each of the aforesaid pixels 116 can be represented by the equivalent circuit shown in FIG. 14 (*a*). More specifically, generally, the pixel 116 associated with the intersection of the scanning line 312 of an i-th line (i is an integer satisfying $1 \leqq i \leqq 160$) and the data line 212 of a j-th column (j is an integer satisfying $1 \leqq j \leqq 120$) can be expressed by a series circuit of the TFD 220 represented by a parallel circuit of a resistor $R_T$ and a capacitor $C_T$ and the liquid crystal capacitor 118 represented by a parallel circuit of a resistor $R_{LC}$ and a capacitor $C_{LC}$, as shown in the diagram.

Figure 15:
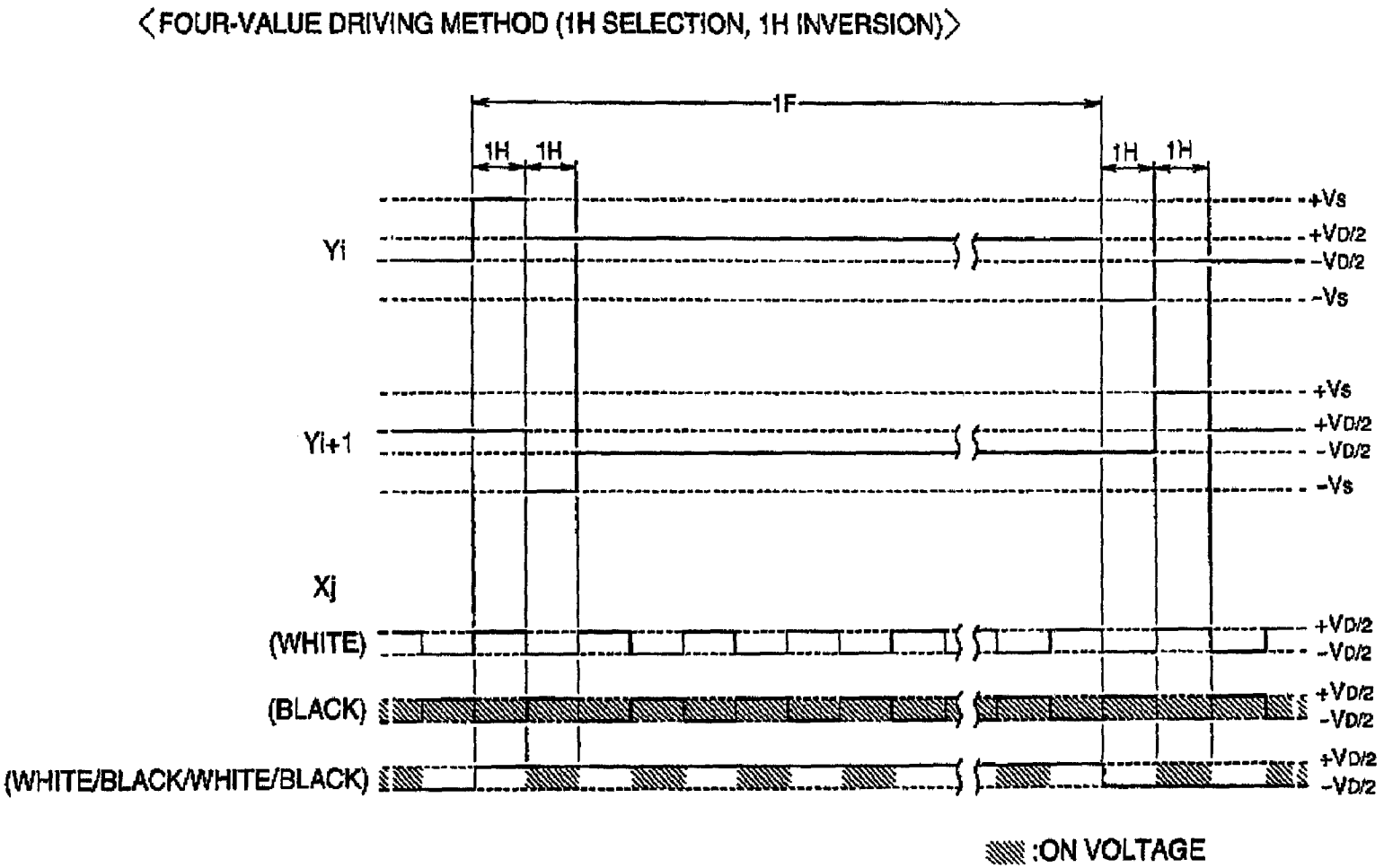
FIG. 15 is a diagram showing the examples of waveforms of scanning signals Yi and Yi+1 and a data signal Xj in a 4-value driving method (1H selection, 1H inversion)

The descriptions will now be given of the four-value driving method (1H selection, 1H inversion), which is a general driving method. FIG. 15 is a diagram showing an example of a waveform of a scanning signal Yi and a data signal Xj applied to the pixel 116 of line i and column j in the four-value driving method (1H selection, 1H inversion).

In this driving method, as the scanning signal Yi, a selection voltage $+V_S$ is applied in one horizontal scanning period (1H), then a non-selection voltage $+V_D/2$ is applied in a non-selection (holding) period. When one vertical scanning period (1F) elapses from the previous selection, a selection voltage $-V_S$ is applied, and a non-selection voltage $-V_D/2$ is applied in the non-selection period. This operation is repeated, while one of voltages $\pm V_D/2$ is applied as the data signal Xj.

At this time, an operation for inverting the polarity of the selection voltage for each horizontal scanning period (1H) is also performed so that, if a selection voltage $+V_S$ is applied as a scanning signal Yi to a certain scanning line 312, then a selection voltage $-V_S$ is applied as a scanning signal Yi+1 to the scanning line 312 of the following line.

Meanwhile, if the selection voltage $+V_S$ is applied and the pixels 116 are to provide black display in a normally white mode, then the voltage of a data signal Xj is $-V_D/2$, or $+V_D/2$ if the pixels 116 are to provide white display. Furthermore, if the selection voltage $-V_S$ is applied and the pixels 116 are to provide black display, then the voltage is $+V_D/2$, or $-V_D/2$ if the pixels 116 are to provide white display.

Figure 16:
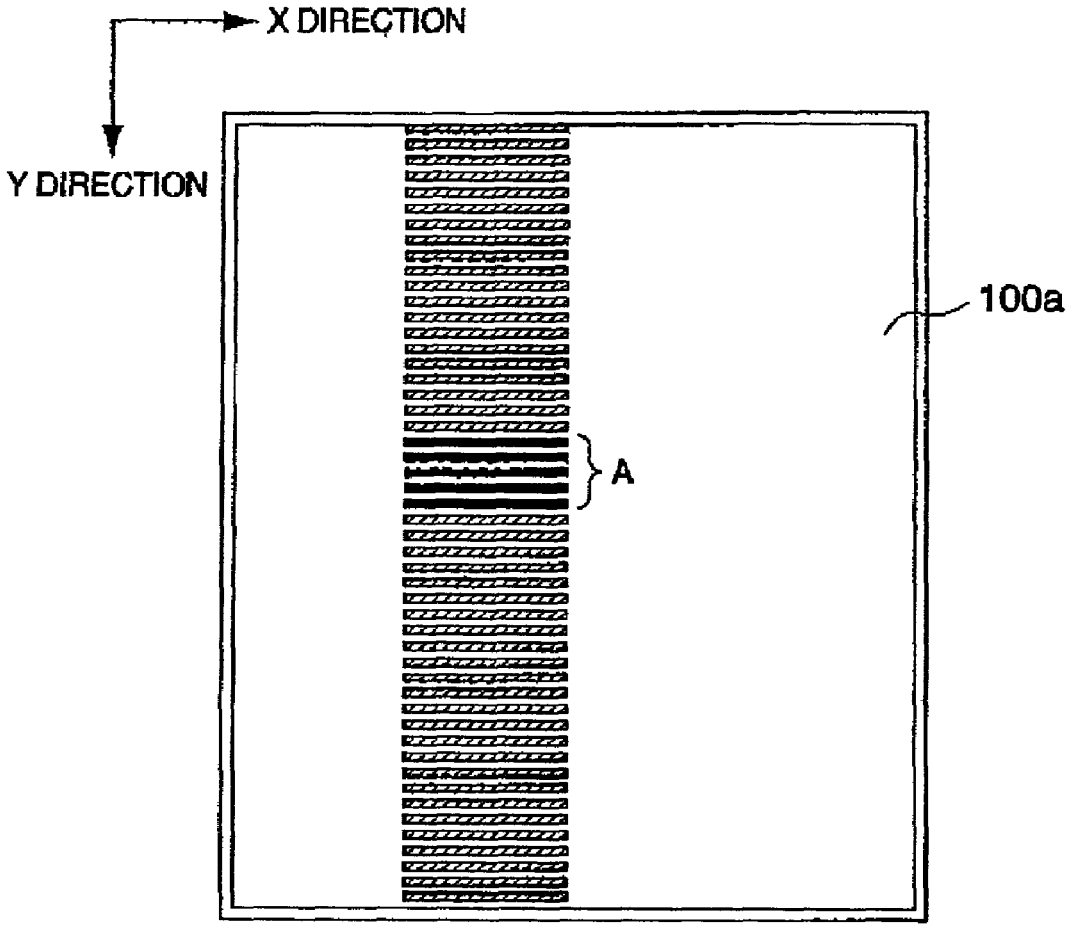
FIG. 16 is a diagram for explaining a display failure.

Incidentally, the four-value driving method (1H selection, 1H inversion) has been known to pose a problem in that cross talk occurs when the zebra display is performed in which white lines and black lines are alternately displayed in a region A of a display screen 100*a*, while the rest of the area is set, for example, for white display only as shown in, for example, FIG. 16. In other words, the problem arises in which white display accompanying shade differences appears in a direction Y with respect to region A.

A cause for this problem may be briefly explained as follows. First, the equivalent circuit of the pixel 116 is as shown in FIG. 14 (*a*). More specifically, the TFD 220 turns OFF in the non-selection period, causing its resistor $R_T$ to grow sufficiently large. The resistor $R_{LC}$ of the liquid crystal capacitor 118 is sufficiently large regardless of the ON or OFF state of the TFD 220. Therefore, the equivalent circuit of the pixel 116 in the non-selection period (holding period) may be represented by a series connection circuit of the capacitor $C_T$ and the capacitor $C_{LC}$, ignoring these resistors. Thus, a voltage determined by the capacitance ratio of the capacitor $C_T$ and the capacitor $C_{LC}$ will be applied to both ends of the capacitor $C_{LC}$.

Next, the voltage of the scanning lines in the non-selection period (the non-selection voltage) is constant, while the voltage of the data lines generally changes between the voltages of $\pm V_D/2$. For this reason, the capacitor $C_{LC}$ is influenced by voltage changes determined by the capacitance ratio of the capacitor $C_T$ and the capacitor $C_{LC}$. For instance, if the voltage changes in the positive direction, then the absolute value of the voltage applied to the capacitor $C_{LC}$ increases if the capacitor $C_{LC}$ is charged in the positive direction, the scanning line Yi side providing the reference. If the capacitor $C_{LC}$ is charged in the negative direction, then the absolute value of the voltage applied to the capacitor $C_{LC}$ decreases.

Referring back to FIG. 16, when the zebra display is carried out in region A, in the data signal to the data lines involved in region A, the switching cycle of the voltages of $\pm V_D/2$ coincides with the inverting cycle of the scanning signals. Hence, the data signal will be fixed to one of the voltages of $\pm V_D/2$ over the period during which the scanning lines involved in region A are selected. This means that the pixels in a region adjacent to region A in the Y direction will be fixed to one of the voltages of $\pm V_D/2$ over a particular period in the holding period, the particular period being the period during which data signals associated with region A are supplied.

And, as mentioned above, the selection voltages of the scanning lines adjacent to each other carry polarities that are opposite to each other, and the polarities with which the capacitor $C_{LC}$ is charged are also opposite. Hence, if the voltage of data signals is fixed to one voltage, then the line of the capacitor $C_{LC}$ with an increased absolute value of an applied voltage and the line of the capacitor $C_{LC}$ with a reduced absolute value of the applied voltage will alternately appear during the period in which the voltage is fixed.

Accordingly, the effective values of the voltage applied to the pixels in the region adjacent to region A in the Y direction will be different from each other in odd-numbered lines and even-numbered lines. As a result, the shade differences take place between the pixels 116 of odd-numbered lines and the pixels 116 of even-numbered lines in the region adjacent to region A in the Y direction, leading to the cross talk mentioned above. Such cross talk occurs for the same reason when a checkered pattern display is performed in addition to the zebra display.

Figure 17:
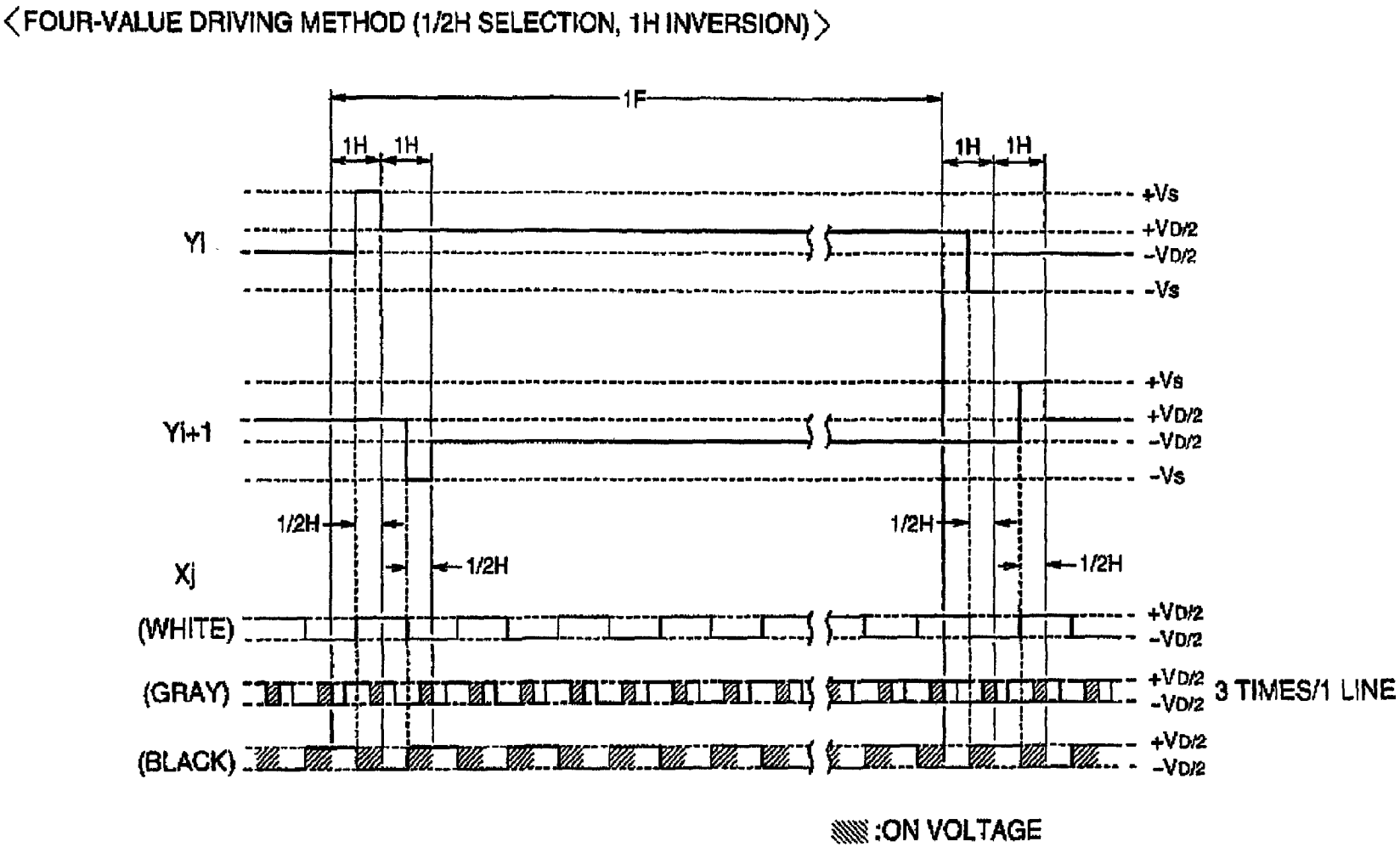
FIG. 17 is a diagram showing the examples of waveforms of scanning signals Yi and Yi+1 and a data signal Xj in a 4-value driving method (½H selection, 1H inversion)

Therefore, in order to solve the cross talk problem, a driving method called the four-value driving method (½H selection, 1H inversion) can be used. In this driving method, as shown in FIG. 17, one horizontal scanning period (1H) in the four-value driving method (1H selection, 1H inversion) is divided into two, a first half period and a latter half period. In one period, i.e., the latter half period ½H, a selection voltage is applied to a scanning line, and the ratio of the period during which the voltage of $-V_D/2$ is applied to the period during which the voltage of $+V_D/2$ is applied to a data signal over one horizontal scanning period 1H is set to 50% each. According to the four-value driving method (½H selection, 1H inversion), regardless of the pattern displayed, the period during which the voltage of $-V_D/2$ is applied and the period during which the voltage of $+V_D/2$ is applied in the data signal Xj will be fifty-fifty, so that the occurrence of the aforesaid cross talk will be prevented.

However, the driving method known as the four-value driving method (½H selection, 1H inversion) poses a problem in that, especially when gray scale display is carried out, the voltage of the data signal Xj is switched more frequently. For example, the voltage of the data signal Xj supplied to the data line 212 of the j-th column is switched three times each time one scanning line 312 is selected (for each horizontal scanning period) when pixels to be in intermediate scales (gray) continue in the column direction, as shown in FIG. 17.

In order to explain the problem with the increase in the voltage switching frequency of the data signal Xj, attention will be focused on the non-selection period that occupies the majority of one vertical scanning period (1F).

Figure 18:
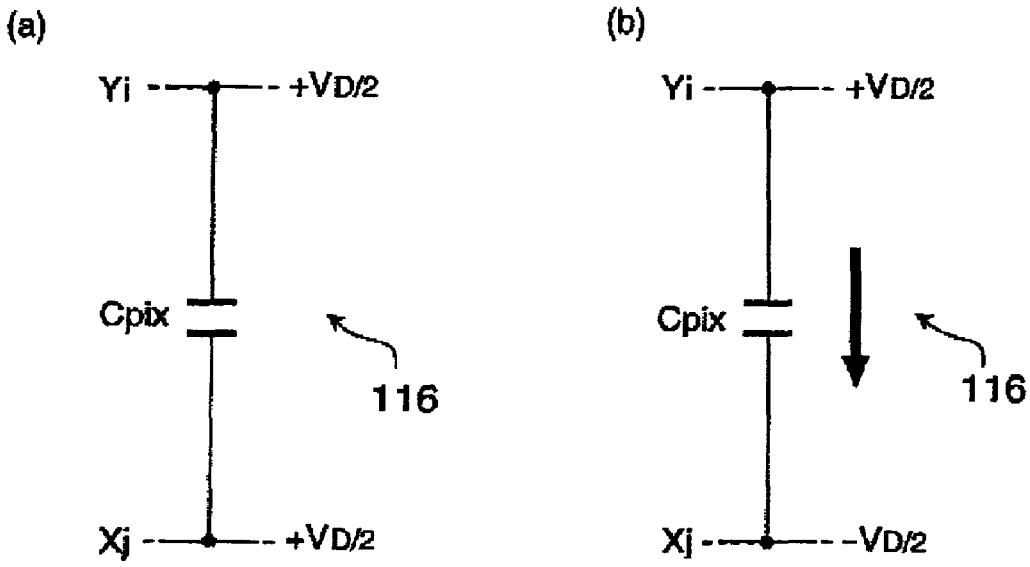
FIGS. 18 (*a*) and (*b*) are diagrams for explaining power consumption attributable to the voltage switching of the data signal Xj during a non-selection period (holding period)
Figure 22:
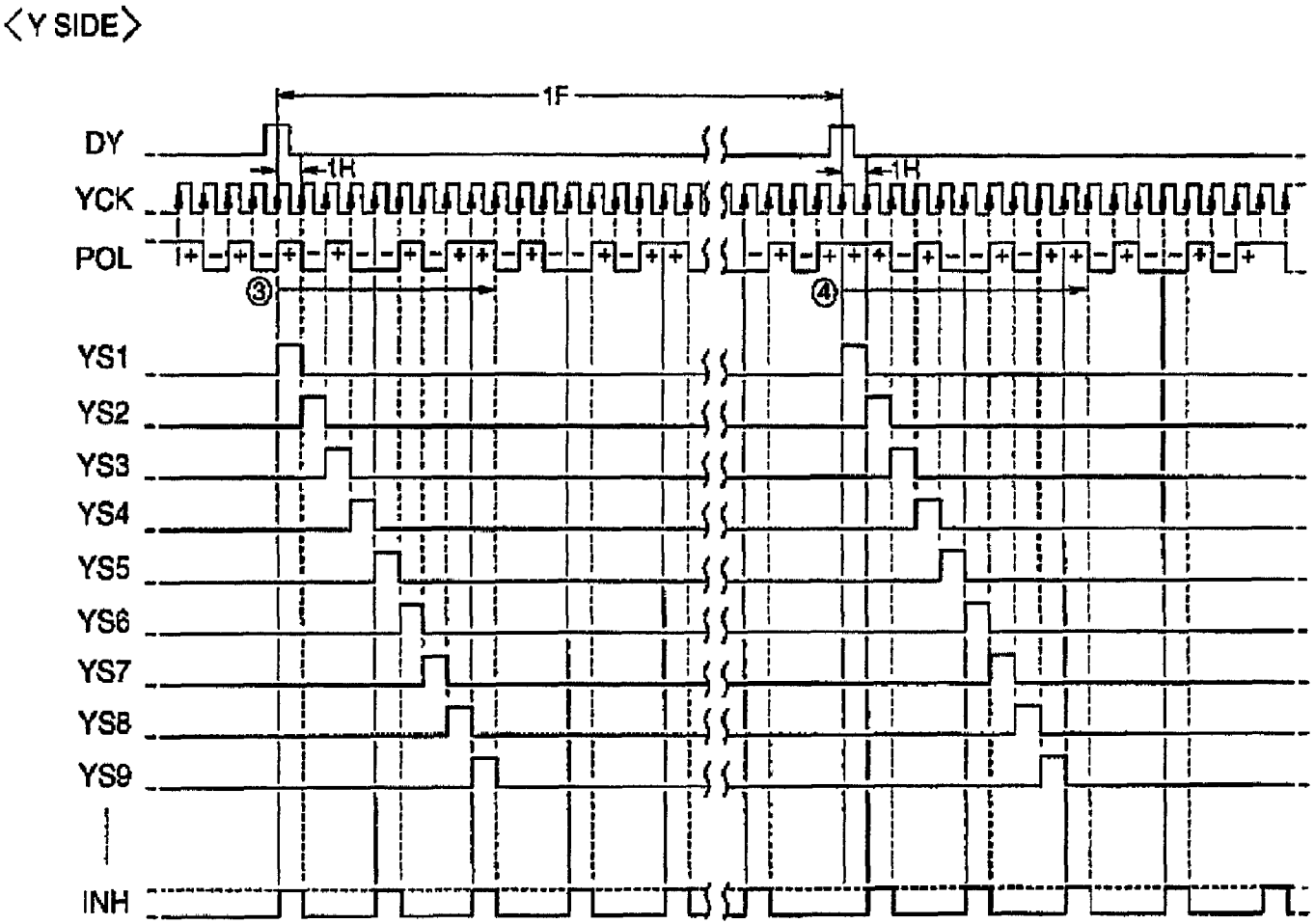
FIG. 22 is a timing chart showing a control signal INH, etc. in the display device.

In the non-selection period, the TFD 220 turns OFF, causing its resistor $R_T$ (refer to FIG. 14 (*a*)) to grow sufficiently large. The resistor $R_{LC}$ of the liquid crystal capacitor 118 is sufficiently large regardless of whether the TFD 220 is ON or OFF. Therefore, the equivalent circuit of the pixel 116 in the holding period may be represented by a capacitor $C_{pix}$ composed of a series synthesized capacitor of the capacitor $C_T$ and the capacitor $C_{LC}$, as shown in FIG. 18 (*a*) or (*b*). The capacitor $C_{pix}$ is expressed by $(C_T \cdot C_{LC})/(C_T+C_{LC})$.

Next, as shown in FIG. 18 (*a*), it is assumed that, if the scanning line 312 of, for example, an i-th line is non-selection, and the scanning signal Yi to the scanning line is held at, for example, the non-selection voltage $+V_D/2$, then the voltage of the data signal Xj to the data line 212 of the j-th column is $+V_D/2$. From this state, when the voltage of the data signal Xj is switched to $-V_D/2$, as shown in FIG. 18 (*b*), the electric charges of $C_{pix} \cdot V_D$ are supplied to one pixel 116. Thus, when voltage switching takes place in the data signal Xj during the non-selection period, charging or discharging is carried out in the capacitors $C_{pix}$ of substantially all pixels 116 connected to the data line 212 of the j-th column (the pixels associated with the intersections with a selected scanning line being excluded). In this case, the descriptions have been given of the capacitors $C_{pix}$ in the pixels 116. The data lines, however, have various other parasitic capacitors. For instance, as shown in FIG. 3 and FIG. 4, the scanning lines 312 and the data lines 212 intersect and oppose each other with the liquid crystal 160 or the like sandwiched therebetween, thus forming a parasitic capacitor having the liquid crystal 160 or the like as a dielectric.

Accordingly, more frequent voltage switching of the data signal Xj means more frequent charging and discharging in the capacitor $C_{pix}$ and various parasitic capacitors, causing electric power to be consumed. This can be a major factor interfering with the achievement of reduced power consumption.

Therefore, the display device in accordance with the embodiment uses a method wherein the selection voltage is applied over the entire one horizontal scanning period rather than dividing one horizontal scanning period into the first half period and the latter half period in order to restrain the occurrence of cross talk and to reduce the voltage switching frequency of the data signal Xj. First, a plurality of scanning lines are bundled into a block, and second, in the same block, the polarity of the selection voltage is inverted each time one scanning line is selected, whereas the polarity of the selection voltage of the scanning line selected lastly in a block is the same as the polarity of selection voltage of the scanning line selected firstly in the following block. For the convenience of explanation, in this embodiment, the number of scanning lines constituting one block is set to "4" in describing the circuits for supplying scanning signals and data signals.

First, the signals used for Y (vertical scanning) side among diverse signals, such as control signals and clock signals, generated by the control circuit 400 in FIG. 1 will be explained.

Figure 6:
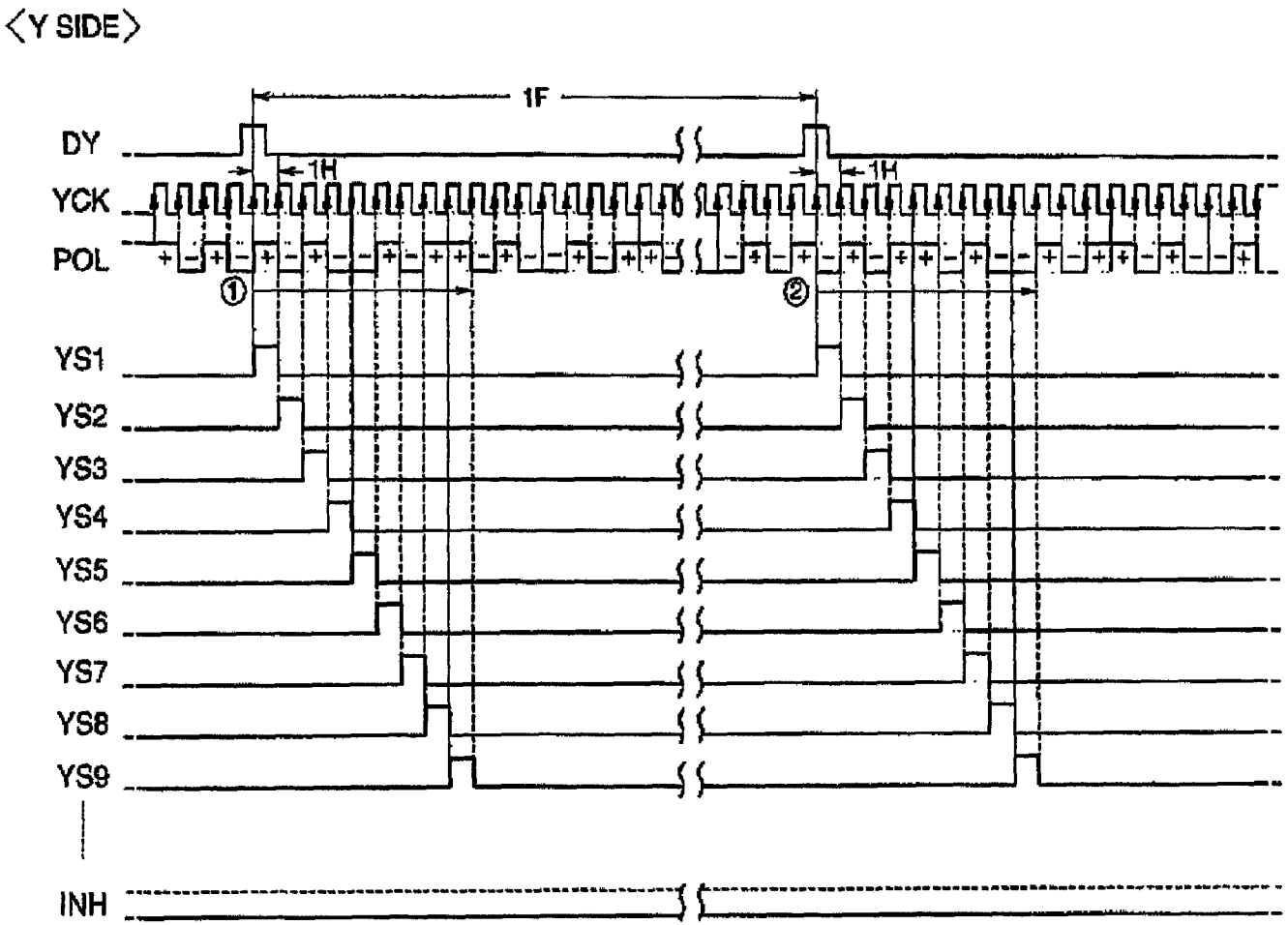
FIG. 6 is a timing chart for explaining the operation of the Y driver.

Firstly, a start pulse DY is a pulse output first in one vertical scanning period (1F), as shown in FIG. 6.

Secondly, a clock signal YCK is a reference signal of the Y side, and has a cycle of one horizontal scanning period (1H), as shown in the drawing.

Thirdly, a polarity indicating signal POL is a signal for indicating the polarity of a selection voltage in a scanning signal, and is output according to the table shown in FIG. 8, taking the logic levels shown in FIG. 6. To be more specific, in the polarity indicating signal POL, during four horizontal scanning periods in which four scanning lines for making up one block (block period) are selected, the logic level is inverted for each horizontal scanning period (1H), and the logic level in the first one horizontal scanning period in the following block period is the same as the logic level in the last one horizontal scanning period in the immediately preceding block. Furthermore, because of AC drive, the polarity indicating signal POL carries a relationship in which the logic level is inverted between a certain vertical scanning period (frame) and immediately preceding and following vertical scanning periods. In FIG. 6, "+" means that a selection voltage of positive polarity is applied, while "−" means that a selection voltage of negative polarity is applied.

The descriptions will now be given of the signals used by the X (horizontal scanning) side.

Figure 10:
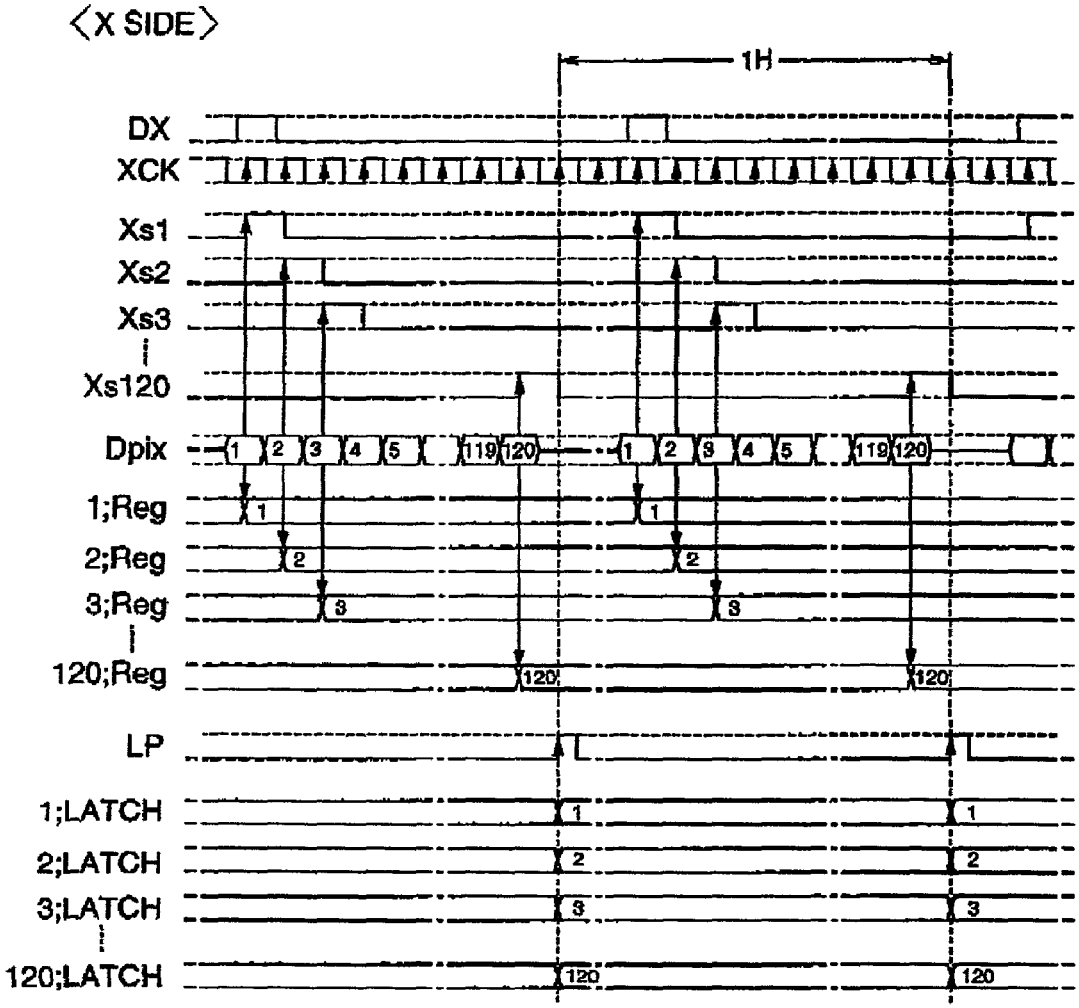
FIG. 10 is a timing chart for explaining the operation of the X driver.

Firstly, a start pulse DX is a pulse output at the timing when the supply of gray scale data Dpix for one line is started, as shown in FIG. 10. In this case, the gray scale data Dpix is the data indicating the gray scales of pixels, and is composed of three bits in this embodiment for the purpose of convenience. Hence, the display device in accordance with the embodiment will perform shade display of 8 ($=2^3$) gray scales on the basis of the 3-bit gray scale data Dpix for each pixel.

Secondly, a clock signal XCK is a reference signal of the X side, and its cycle corresponds to the period in which the gray scale data Dpix for one pixel is supplied, as shown in the drawing.

Thirdly, a latch pulse LP is a pulse that rises at the start of one horizontal scanning period (1H), and it is a pulse output at a timing after the gray scale data Dpix for one line is supplied, as shown in FIG. 10.

Figure 11:
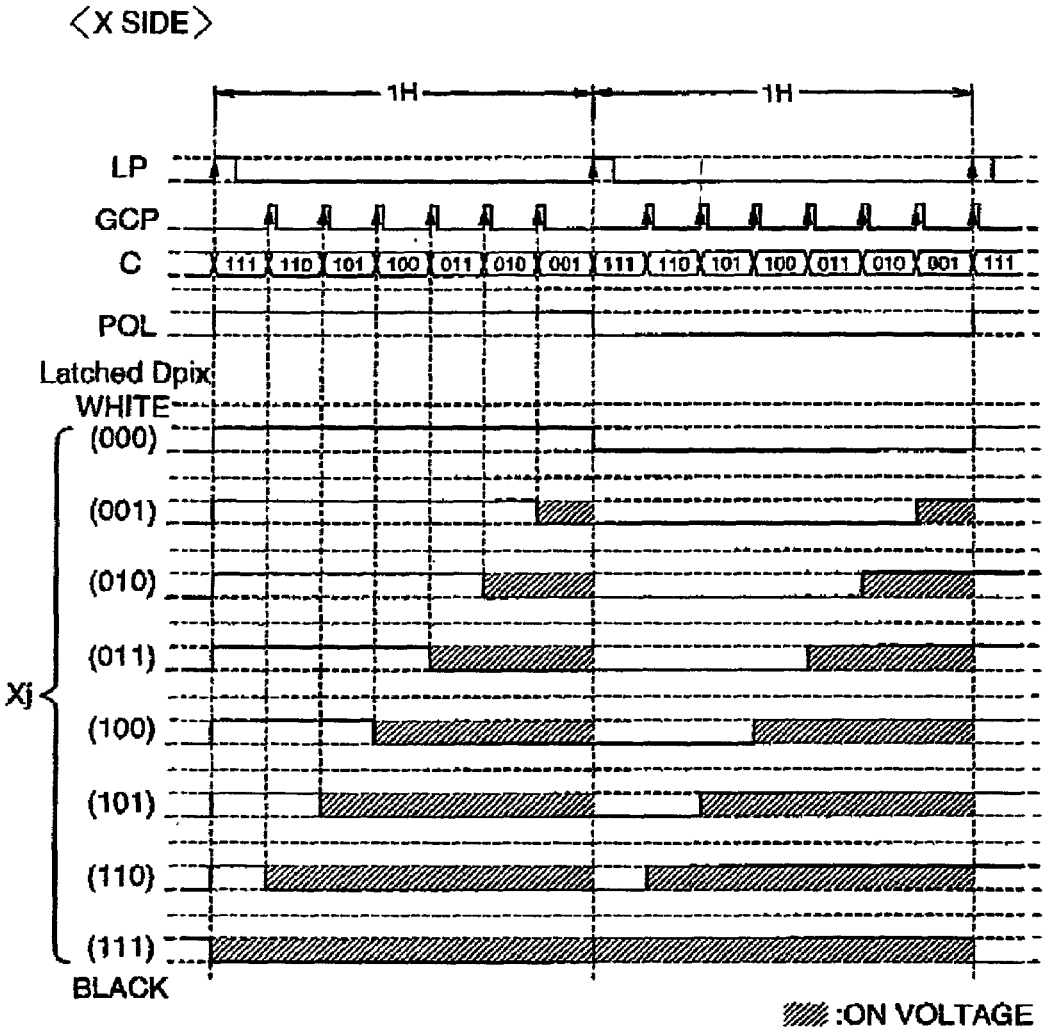
FIG. 11 is a timing chart for explaining the voltage waveform of a data signal supplied to the X driver.

Fourthly, gray scale code pulses GCP are the pulses arranged respectively at the positions of the periods associated with intermediate gray scales in one horizontal scanning period (1H), as shown in FIG. 11. In this embodiment, if it is assumed that white display is designated if the 3-bit gray scale data Dpix is (000), while black display is designated if it is (111), then the gray scale code pulses GCP are the pulses arranged in (correspondence with six gray scales (110), (101), (100), (011), (010), and (001), excluding white or black, in one horizontal scanning period (1H).

In FIG. 11, the gray scale code pulses GCP are actually set, considering the voltage to be applied to a pixel vs. intensity characteristic (V-I characteristic).

Figure 5:
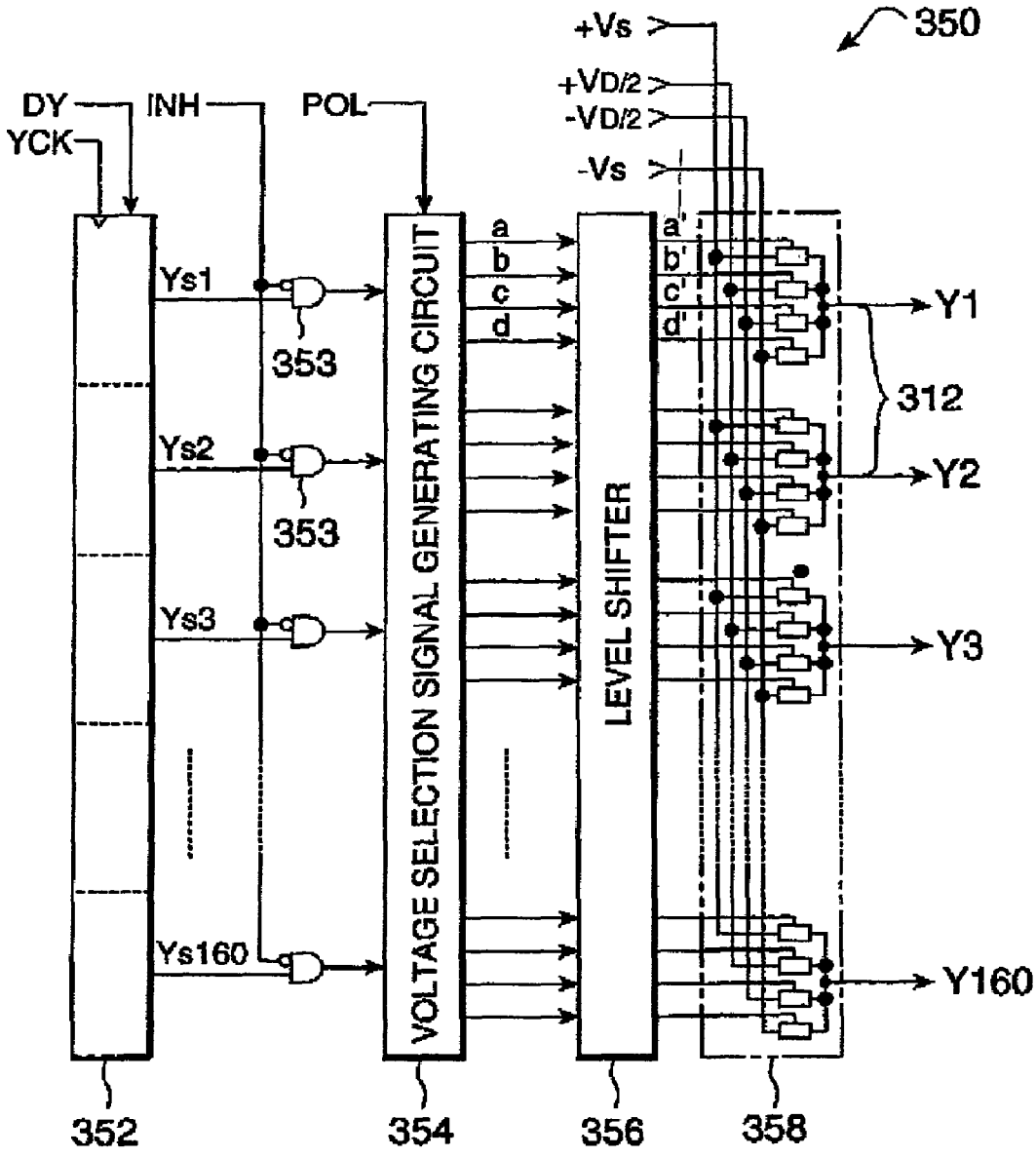
FIG. 5 is a block diagram showing the construction of a Y driver in the display device.

The Y driver 350 will now be described in detail. FIG. 5 is a block diagram showing the configuration of the Y driver 350. In the drawing, a shift register 352 is a shift register of 160 bits corresponding to the total number of the scanning lines 312.

To be more specific, the shift register 352 sequentially shifts the start pulse DY, which is supplied first in one vertical scanning period, according to the clock signal YC to sequentially output transfer signals YS1, YS2, YS3, . . . , YS160. In this case, the transfer signals YS1, YS2, YS3, . . . , YS160 respectively correspond on a one-to-one basis to the scanning lines 312 of the 1st line, 2nd line, 3rd line, . . . , 160th line, and it means that if any one of the transfer signals goes to H level, then the scanning line 312 associated therewith should be selected.

The transfer signals YS1, YS2, YS3, . . . , YS160 are supplied to one end of each of AND circuits 353 provided for the respective lines. Meanwhile, the inverted signal of a control signal INH is commonly supplied to the other end of the AND circuit 353 of each line. However, in this embodiment, the control signal INH is always at L level, so that the outputs of the AND circuits 353 of the respective lines will be the transfer signals YS1, YS2, YS3, . . . , YS160 as they are. The configuration for using the control signal INH will be explained in an application example, which will be described later.

A voltage selection signal generating circuit 354 outputs one of voltage selection signals a, b, c, and d that decides the voltage to be applied to the scanning line 312 from the polarity indicating signal POL for each scanning line 312, in addition to the transfer signals YS1, YS2, YS3, . . . , YS160.

In this embodiment, the voltage of the scanning signal applied to the scanning lines 312 takes four values, namely, $+V_S$ (positive-polarity selection voltage), $+V_D/2$ (positive polarity non-selection voltage), $-V_S$ (negative-polarity selection voltage), and $-V_D/2$ (negative-polarity non-selection voltage). Of these, the non-selection voltage is $+V_D/2$ after the selection voltage $+V_S$ is applied, or $-V_D/2$ after the selection voltage $-V_S$ is applied, and it is uniquely defined by the immediately preceding selection voltage.

Hence, the voltage selection signal generating circuit 354 outputs one of the voltage selection signals a, b, c, and d in one scanning line such that the voltage levels of the scanning signals have the following relationship. Specifically, if one of the transfer signals YS1, YS2, . . . , YS160 is switched to the H level and an indication is given that it is the horizontal scanning period during which the scanning line 312 corresponding to the above transfer signal at the H level should be selected, then the voltage selection signal generating circuit 354 generates a voltage selection signal so as to set the voltage level of the scanning signal to the scanning line 312 first to the selection voltage of the polarity corresponding to the signal level of the polarity indicating signal POL, and then to the non-selection voltage corresponding to the aforesaid selection voltage when the aforesaid transfer signal is shifted to L level.

To be specific, when a transfer signal is switched to the H level, if the polarity indicating signal POL is at the H level, then the voltage selection signal generating circuit 354 outputs the voltage selection signal "a" for the line associated with the aforesaid transfer signal, which causes the positive-polarity selection voltage $+V_S$ to be selected, during the aforesaid period. Thereafter, when the aforesaid transfer signal is switched to the L level, then the voltage selection signal generating circuit 354 outputs the voltage selection signal "b" that causes the positive-polarity non-selection voltage $+V_D/2$ to be selected, whereas it outputs the voltage selection signal "c" for the line associated with the aforesaid transfer signal, which causes the negative-polarity voltage $-V_S$ to be selected, during the aforesaid period if the polarity indicating signal POL is at the L level when the transfer signal is switched to the H level. After that, when the aforesaid transfer signal is switched to the L level, then the voltage selection signal generating circuit 354 outputs the voltage selection signal "d" that causes the negative-polarity non-selection voltage $-V_D/2$ to be selected.

A level shifter 356 increases the voltage amplitudes of the voltage selection signals a, b, c, and d output by the voltage selection signal generating circuit 354.

A selector 358 actually selects voltages indicated by voltage selection signals a', b', c', and d' whose voltage amplitudes have been increased, and applies the selected voltages as the scanning signals to the corresponding scanning lines 312.

The operation of the Y driver 350 will now be described in order to explain the voltage waveforms of the scanning signals. First, as shown in FIG. 6, when the start pulse DY is supplied at the beginning of one vertical scanning period (1F), the start pulse DY is transferred by the shift register 352 according to the clock signal YCK. As a result, the transfer signals are exclusively switched to the H level in the order of YS1, YS2, YS3, . . . , YS160.

Meanwhile, the voltage of a scanning signal is indicated by the logic level of the polarity indicating signal POL at the time when the associated transfer signal is switched to the H level. In general, when attention is focused on the scanning line 312 of the i-th line, the scanning signal Yi supplied to the scanning line will be at the positive-polarity selection voltage $+V_S$ if the polarity indicating signal POL is at the H level when a transfer signal YSi is switched to the H level, and thereafter, will be held at the positive-polarity non-selection voltage $+V_D/2$. If the polarity indicating signal POL is at the L level when the transfer signal YSi is switched to the H level, then the scanning signal Yi will be at the negative-polarity selection voltage $-V_S$, and thereafter held at the negative-polarity non-selection voltage $-V_D/2$.

Figure 7:
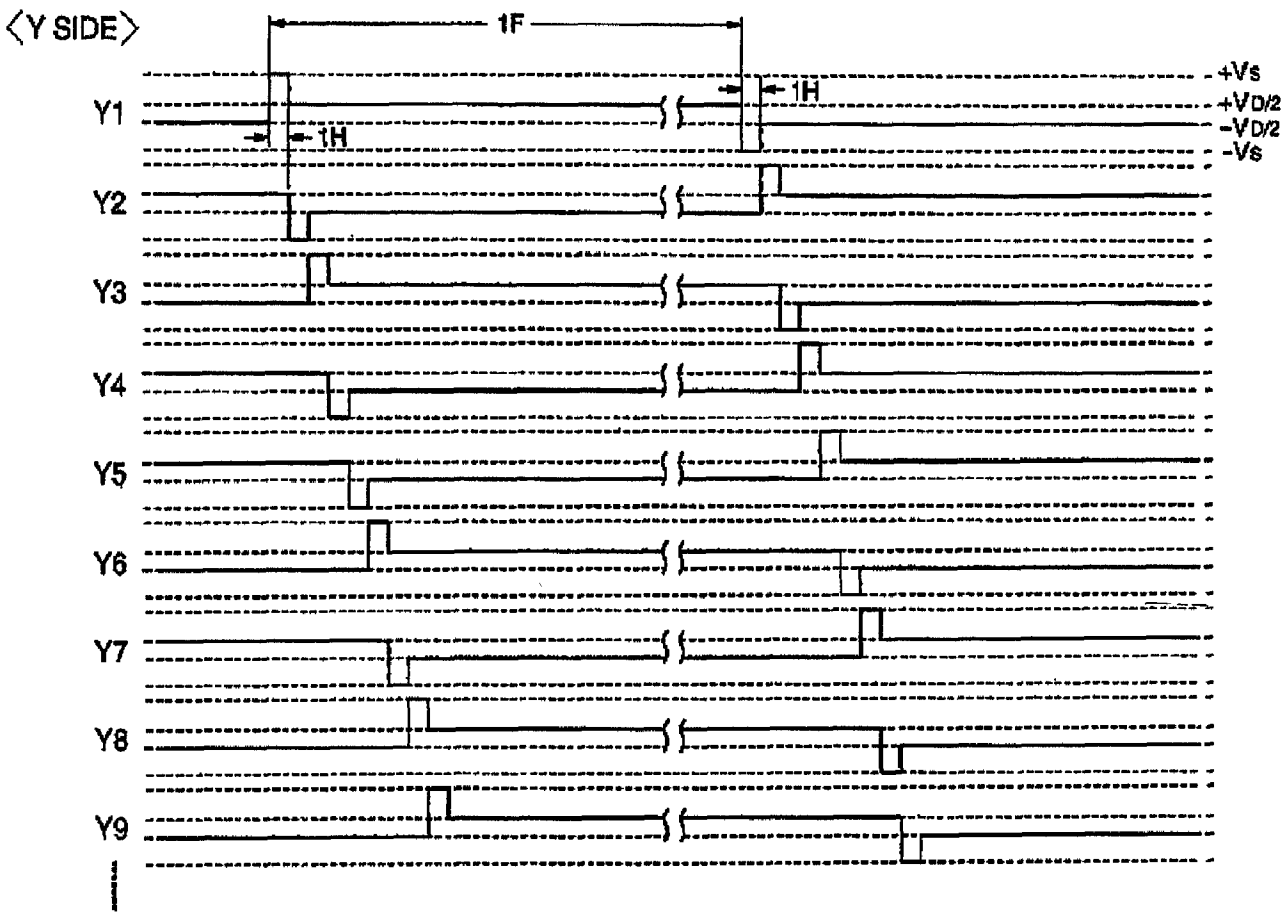
FIG. 7 is a diagram for explaining the voltage waveform of a scanning signal supplied by the Y driver.

Furthermore, the polarity indicating signals POL are output by the control circuit 400 according to the timetable shown in FIG. 8. Thus, the voltage waveforms of the scanning signals will be as shown in FIG. 7.

More specifically, the polarity indicating signals POL are level-inverted for each horizontal scanning period during the period in which the four scanning lines 312 making up one block are selected (refer to FIG. 6), meaning that the polarity of the scanning signals is inverted for each scanning line. In other words, the positive-polarity selection voltage and the negative-polarity selection voltage are alternately selected for each horizontal scanning period (1H).

Furthermore, in the polarity indicating signal POL, the logic level of the period during which the scanning line 312 is lastly selected in a certain block is the same as the logic level of the period during which the scanning line 312 is firstly selected in a block following the aforesaid block. Hence, the selection voltages supplied to the two scanning lines 312 positioned at the boundary of blocks will have the same polarity.

When attention is focused on the same scanning line 312, the logic level of the polarity indicating signal POL is inverted for each vertical scanning period (refer to FIG. 6 and FIG. 8). Therefore, if the selection voltage when a certain scanning line is selected in a certain vertical scanning period is, for example, the positive selection voltage $+V_S$, then the selection voltage when the scanning line is selected in the following vertical scanning period will be the negative selection voltage $-V_S$.

Figure 9:
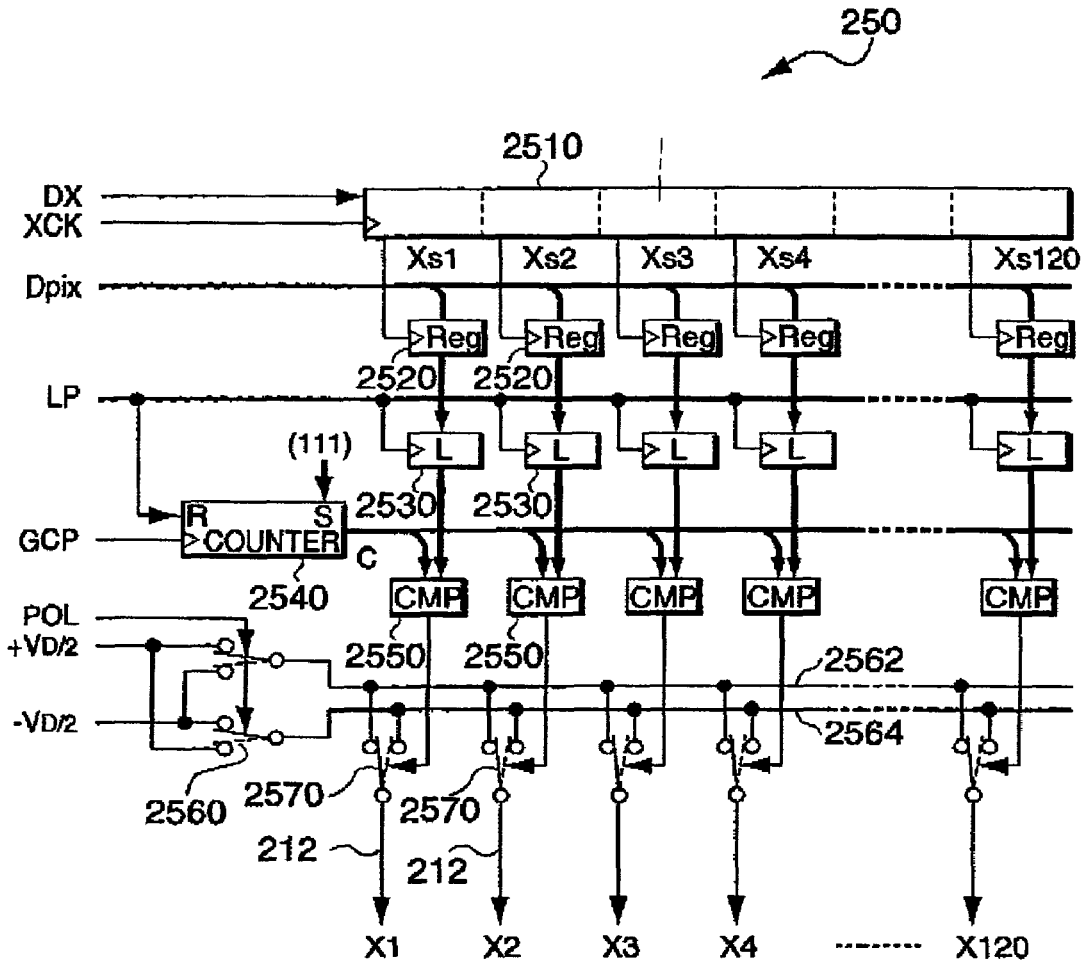
FIG. 9 is a block diagram showing the construction of an X driver in the display device.

The details of the X driver 250 will now be described in detail. FIG. 9 is a block diagram showing the configuration of the X driver 250. In the drawing, a shift register 2510 sequentially shifts the start pulses DX, which are output at the timing when the supply of the gray scale data Dpix for one line is started, for each rise of the clock signal XCK, and outputs them as sampling control signals Xs1, Xs2, Xs3, . . . , Xs120.

Subsequently, register (Reg) 2520 provided to correspond on a one-to-one basis to the data lines 212 sample the 3-bit gray scale data Dpix supplied in synchronization with the clock signal XCK at the rise of a sampling control signal and retain them. Latching circuits (L) 2530 provided to correspond on a one-to-one basis to the registers 2520 latch the gray scale data Dpix retained by the corresponding registers 2520 by latching pulses LP that rise at the starts of the horizontal scanning periods, and output them.

Meanwhile, a counter 2540 is set at the rise of the latching pulse LP by using (111), which corresponds to the black display of gray scale data, as the initial value, decrements the initial value for each rise of the gray scale code pulse GCP, and outputs count results C.

Subsequently, a comparator (CMP) 2550 provided to correspond on a one-to-one basis to the latching circuits 2530 compares the count results C by the counter 2540 with the gray scale data Dpix latched by corresponding latching circuits 2530, and outputs a signal for setting the H level when the latter exceeds the former.

A switch 2560 is set to the position indicated by the solid lines in the drawing to supply a data voltage $+V_D/2$ to a voltage supply line 2562 and a data voltage $-V_D/2$ to a voltage supply line 2564, respectively, if the polarity indicating signal POL is at the H level, while the switch 2560 is set to the position indicated by the dashed lines in the drawing to supply the data voltage $+V_D/2$ to the voltage supply line 2564 and the data voltage $-V_D/2$ to the voltage supply line 2562, respectively, if the polarity indicating signal POL is at the L level.

Switches 2570 are provided to correspond on a one-to-one basis to the comparator 2550, that is, to the data lines 212. To be more specific, the switches 2570 select the voltage supply line 2562 as indicated by the solid lines in the drawing if the signal indicating the comparison result by the comparator 2550 is at the L level, while the switches 2570 select the voltage supply line 2564 as indicated by the dashed lines in the drawing if the aforesaid signal is at the H level so as to apply, as data signals, the data voltages supplied to the respective selected voltage supply lines to corresponding data lines 212.

The operation of the X driver 350 will now be discussed in order to explain the voltage waveforms of data signals. First, as shown in FIG. 10, when the start pulse DX rises to the H level, the gray scale data Dpix corresponding to the pixels of the 1st column, the 2nd column, the 3rd column, . . . , 120th column of any one of the lines is sequentially supplied.

When the sampling control signal Xs1 output from the shift register 2510 rises to the H level at the timing when the gray scale data Dpix corresponding to the pixel of the 1st column among the aforesaid pixels is supplied, the gray scale data is sampled by the register 2520 corresponding to the 1st column.

Next, when the sampling control signal Xs2 rises to the H level at the timing when the gray scale data Dpix corresponding to the pixel of the 2nd column is supplied, the gray scale data is sampled by the register 2520 corresponding to the 2nd column. Thereafter, in the same manner, the gray scale data Dpix corresponding to the pixels of the 3rd column, the 4th column, . . . , 120th column is sampled by the registers 2520 corresponding to the 3rd column, the 4th column, . . . , 120th column.

Subsequently, when the latching pulse LP is output (when its logic level rises to the H level), the gray scale data Dpix sampled by the registers 2520 of the respective columns are simultaneously latched by the latching circuits 2530 corresponding to the individual columns. Then, the latched gray scale data Dpix and the count results C provided by the counter 2540 are respectively compared by the comparator 2550.

Meanwhile, the count results C are the values obtained by decrementing (111), which has been set at the rise of the latching pulse LP, by the counter 2550 each time the gray scale code pulse GCP rises, as shown in FIG. 11.

Here, a case is assumed where the gray scale data Dpix latched by the latching circuit 2530 of the j-th column generally corresponds to white (000). In this case, even when the gray scale code pule GCP is output six times after the latching pulse LP is output, the count result C does not decrement to the latched (000) or less. Therefore, the output signal by the comparator 2550 of the j-th column maintains the L level over one horizontal scanning period defined by the aforesaid latching pulse LP. For this reason, the selection of the voltage supply line 2562 is maintained by the switch 2570 of the j-th column.

And if the polarity indicating signal POL is at the H level during the aforesaid horizontal scanning period, then the voltage $+V_D/2$ is supplied to the voltage supply line 2562 by the switch 2560. Hence, the data signal Xj remains at the voltage $+V_D/2$ over the horizontal scanning period, as shown in FIG. 11.

Conversely, if the polarity indicating signal POL is at the L level during the aforesaid horizontal scanning period, then the voltage $-V_D/2$ is supplied to the voltage supply line 2562 by the switch 2560. Hence, the data signal Xj remains at the voltage $-V_D/2$ over the horizontal scanning period, as shown in the drawing.

Another case is assumed where the gray scale data Dpix latched by the latching circuit 2530 of the j-th column generally corresponds to, for example, gray (100). In this case, when the gray scale code pulse GCP is output three times after the latching pulse LP is output, the count result C reaches the latched (100) or less. At this point, therefore, the output signal by the comparator 2550 of the j-th column switches from the L level to the H level. This causes the selection by the switch 2570 of the j-th column to be switched at the aforesaid point from the voltage supply line 2562 to the voltage supply line 2564.

And if the polarity indicating signal POL is at the H level during the aforesaid horizontal scanning period, then the voltage $+V_D/2$ is supplied to the voltage supply line 2562 and the voltage $-V_D/2$ is supplied to the voltage supply line 2564 by the switch 2560, respectively. Hence, the data signal Xj is switched from the voltage $+V_D/2$ to the voltage $-V_D/2$ at the aforesaid point, as shown in FIG. 11.

Conversely, if the polarity indicating signal POL is at the L level during the aforesaid horizontal scanning period, then the voltage $-V_D/2$ is supplied to the voltage supply line 2562 and the voltage $+V_D/2$ is supplied to the voltage supply line 2564 by the switch 2560, respectively. Hence, the data signal Xj is switched from the voltage $-V_D/2$ to the voltage $+V_D/2$ at the aforesaid point, as shown in the same drawing.

Even if the latched gray scale data Dpix corresponds to a gray color other than (100), the same applies except that the switching timing of the output signal by the comparator 2550 is different.

Still another case is assumed where the gray scale data Dpix latched by the latching circuit 2530 of the j-th column generally corresponds to black (111). In this case, as soon as the latching pulse LP is output, the count result C reaches the latched (111) or less; therefore, the output signal by the comparator 2550 of the j-th column maintains the H level over one horizontal scanning period defined by the aforesaid latching pulse LP. For this reason, the selection of the voltage supply line 2564 is maintained by the switch 2570 of the j-th column.

And if the polarity indicating signal POL is at the H level during the aforesaid horizontal scanning period, then the voltage $-V_D/2$ is supplied to the voltage supply line 2564 by the switch 2560. Hence, the data signal Xj remains at the voltage $-V_D/2$ over the horizontal scanning period, as shown in FIG. 11.

Conversely, if the polarity indicating signal POL is at the L level during the aforesaid horizontal scanning period, then the voltage $+V_D/2$ is supplied to the voltage supply line 2562 by the switch 2560. Hence, the data signal Xj remains at the voltage $+V_D/2$ over the horizontal scanning period, as shown in the drawing.

Accordingly, for the same gray scale data Dpix latched by the latching circuit 2530, the data signal Xj in the case where the polarity indicating signal POL is at the H level and the data signal Xj in the case where the polarity indicating signal POL is at the L level are inverted against each other with respect to the central voltage (reference voltage of polarity) of the data voltage $+V_D/2$.

Figure 12:
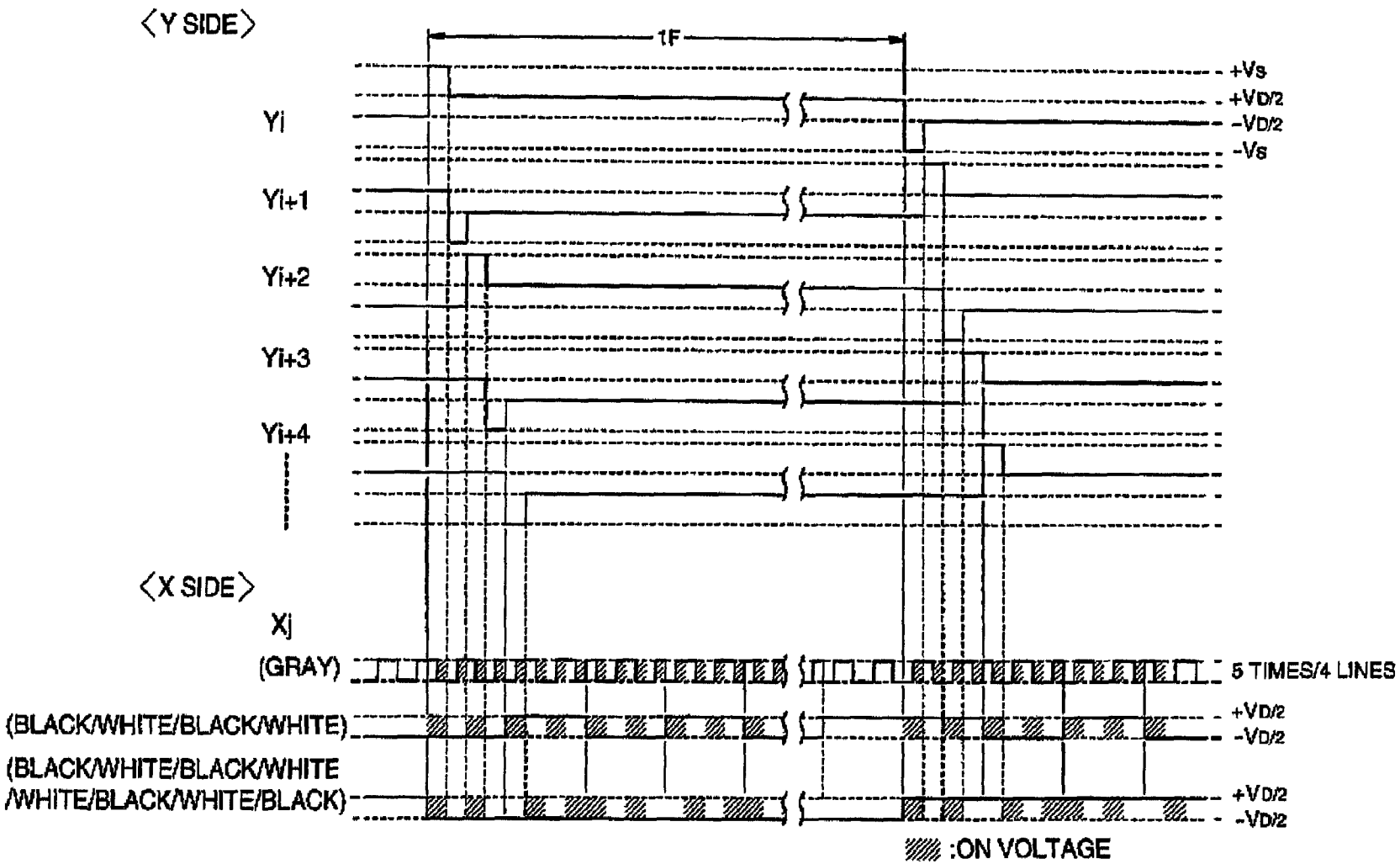
FIG. 12 is a diagram showing voltage waveforms or the like applied to the pixels of the display device.

With reference to FIG. 12, the descriptions will now be given of the aspect in which the switching frequency of data voltage is reduced and the aspect in which cross talk is restrained when the scanning signals are supplied to the scanning lines bundled into blocks as described above in the display device according to this embodiment. FIG. 12 generally shows the voltage waveforms of the scanning signals supplied to the scanning lines 312 from the i-th line to the (i+3)th line that belong to the same block and the scanning line 312 of the (i+4)th line selected first in the block following the aforesaid block, and data signals in this embodiment.

As shown in this drawing, in general, if gray scale pixels (pixels other than white or black) are in succession in the j-th column, the voltage of the data signal Xj supplied to the data line 212 is switched ten times in four horizontal scanning periods required for selecting four scanning lines 312. This is converted into 1.25 times for one horizontal scanning period required for selecting one scanning line 312. This means that according to this embodiment, the switching frequency is significantly reduced, as compared with the three times in the four-value driving method (½H selection, 1H inversion) shown in FIG. 17, so that the power consumption can be reduced accordingly.

Furthermore, when a pattern in which white pixels and black pixels are alternately arranged in the j-th column is displayed, in the four-value driving method (1H selection, 1H inversion) shown in FIG. 15, the data signal Xj is biased to the voltage $+V_D/2$ or $-V_D/2$ according to the polarity of selection voltages. This causes the cross talk illustrated in FIG. 16, as described above.

In contrast with the above, according to this embodiment, even when the pattern in which white pixels and black pixels are alternately arranged in the j-th column is displayed, the period during which the data signal Xj is at the voltage $+V_D/2$ and the period during which the data signal Xj is at the voltage $-V_D/2$ will be half-and-half, as shown in FIG. 12. Therefore, the occurrence of cross talk can be prevented, as in the case of the four-value driving method (½H selection, 1H inversion) shown in FIG. 17.

Figure 13:
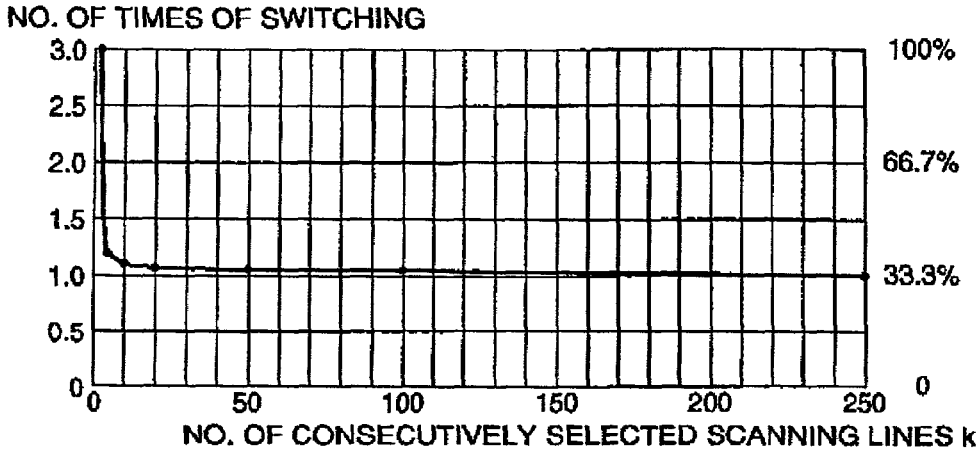
FIG. 13 is a diagram showing the relationship between the number of consecutively selected scanning lines and the number of times of voltage switching (consumed power)

In the embodiment described above, the number of scanning lines consecutively selected has been set to "4" for the sake of convenience, however, it should be understood that the present invention is not limited thereto. When the number of scanning lines to be consecutively selected is denoted as "k", then the number of the switching times of the voltage of a data signal can be expressed as (k+1)/k (times) in terms of the number per horizontal scanning period (one scanning line being selected). Hence, as shown in FIG. 13, as the consecutively selected scanning lines K is set to a larger value, the frequency at which the voltage of a data signal is switched can be reduced.

In the four-value driving method (½H selection, 1H inversion) described above, the voltage switching frequency of the data signal when the intermediate gray scale display is carried out is three times (refer to FIG. 17). Hence, in this embodiment, if the consecutively selected scanning lines k is set to, for example, 10 or more, then the voltage switching frequency of the data signal can be reduced to about 36.7% of that in the four-value driving method (½H selection, 1H inversion).

It should be understood that the present invention is not limited to the embodiment described above, but can be implemented also in the following diverse applications and modifications.

According to the embodiment in which the number of scanning lines making up a block has been set to "4", even in the case of the pattern wherein white pixels and black pixels are alternately arranged in the direction of columns, the period during which the data signal is at the voltage $+V_D/2$ and the period during which the data signal is at the voltage $-V_D/2$ will be half-and-half, so that the occurrence of cross talk has been prevented.

However, in the embodiment, when the pixels corresponding to the polarity of a selection voltage are arranged in the direction of columns, the data signal tends to be biased to the voltage $+V_D/2$ or $-V_D/2$. For instance, in the embodiment, in the case of a repetitious pattern wherein the pixels of the j-th column are black, white, black, white, and white, black, white, black, . . . are repeated, the data signals to be supplied to corresponding data lines 212 will be undesirably biased to the voltage $+V_D/2$ or $-V_D/2$, as shown in FIG. 12. Hence, cross talk will undesirably occur as in the case of the four-value driving method (1H selection, 1H inversion) shown in FIG. 15.

A conceivable solution to the problem of the voltages of the data signals being biased as mentioned above is to set the number of the scanning lines making up a block so that it is different from one block to another. For example, as shown in FIG. 19, setting the number of the scanning lines that make up each block to "5," "4," and "7" in order from top will reduce the incidence of the pattern wherein the voltages of the data signals are biased, and the occurrence of cross talk will be restrained accordingly. Of course, the number of the scanning lines constituting each block is not limited to "5," "4," and "7", and it may be smaller or greater than these values or may be random values. Furthermore, the corrections set forth below may be carried out on the pixels positioned on block boundaries.

According to the embodiment described above, the polarity of a selection voltage in the same block is inverted for each scanning line 312, whereas the selection voltage supplied to the scanning line 312 selected last in a certain block and the selection voltage supplied to the scanning line 312 selected first in the next block have the same polarity, making them different from other portions. This may cause the occurrence of streak-like irregularities along a block boundary (along the scanning line 312 positioned at an end of a block) due to dull waveforms attributable to wire resistance, capacitance, etc. of the scanning line 312 or the like or different in electric field or the like. For instance, the inventor has confirmed that, when display is performed using the same gray scale (intermediate gray scale, in particular) over an entire surface, the pixel positioned on the scanning line 312 selected first in a block is slightly brighter than other portions. In this case, "the pixel is brighter" means that the effective value of the voltage applied to the liquid crystal capacitor 118 is undesirably smaller than its intrinsic value in the normally white mode.

Thus, in the block boundary, it can be considered desirable to carry out the correction of data signals or the correction of scanning signals independently or by combining them as necessary, as it will be described below.

First, according to a conceivable configuration for correcting data signals, the gray scale data of at least the pixel positioned on the scanning line 312 selected last in a block or the pixel positioned on the scanning line 312 selected first in a block is uniformly increased or decreased by an amount corresponding to a certain value, and the result is supplied to the X driver 250. For example, the pixel positioned on the scanning line 312 selected first in a block is brighter than other portions, as set forth above. Therefore, the amount equivalent to the extra brightness can be added beforehand as a correction amount to the gray scale data of the pixel positioned on the scanning line 312 selected first in the block.

The streak-like irregularities occur because the affected portion has a different intensity from that of the rest. According to the corrections described above, the difference in intensity is estimated and added (or subtracted) in advance as a correction amount, resulting in substantially the same intensity in a block boundary. Thus, the occurrence of irregularities can be restrained.

Irregularities can occur more conspicuously on the pixel positioned on the scanning line 312 selected first in a block than the pixel positioned on the scanning line 312 selected last in a block. For this reason, it is considered desirable to implement the correction of gray scale data described above on the pixels positioned on the scanning lines 312 selected first in blocks. More specifically, when the scanning lines 312 hatched in FIG. 8 are selected, it is preferable to correct associated gray scale data. Incidentally, in FIG. 8, the scanning line 312 of the first line is not hatched because this scanning line 312 is selected first in one vertical scanning period, so that it is considered that no irregularities occur since there is no scanning line 312 selected immediately preceding the scanning line, or the influences can be ignored.

As the configuration for correcting data signals, in addition to the configuration wherein the difference in intensity is estimated and added (or subtracted) as the correction amount, there is another possible configuration in which the pulse arrangement of the gray scale code pulses GCP shown in FIG. 11 is temporally shifted. More specifically, it is configured to change the arrangement of the gray scale code pulses GCP, such that, when applying a data signal to the pixel positioned on the scanning line 312 selected first in a block, the application time of an ON voltage is slightly longer than for the pixel of the same gray scale positioned on other scanning lines.

Meanwhile, as a configuration for correcting scanning signals, correcting selection voltages themselves is conceivable. However, implementing the configuration for correcting selection voltages themselves would involve an increased number of the voltages to be generated by the drive voltage generating circuit 500 (refer to FIG. 1), leading to a complicated configuration.

A solution to the above can be to set different application times of a selection voltage in one horizontal scanning period for the scanning line 312 positioned first in a block and for other scanning lines 312. To be more specific, if the pixels positioned on the scanning line 312 selected first in a block is brighter than the pixels positioned on other scanning lines in the normally white mode, then a configuration can be considered in which a selection voltage is applied during the full one horizontal scanning period in which the aforesaid scanning line 312 is selected, while a non-selection voltage is applied in place of the selection voltage at the front edge or the rear edge of the remaining scanning lines 312 (up to the middle of the selection period or from the middle of the selection period). In other words, the time during which the selection voltage is applied to the scanning line selected first in a block is relatively prolonged to make up a shortfall of a voltage effective value.

Such a configuration can be implemented by retaining the control signal INH supplied to the Y driver 350 of FIG. 5 to the H level up to the middle of one horizontal scanning period during which the scanning line 312 positioned at the beginning of a block is selected, or by switching the control signal INH to the H level in the middle thereof.

It is considered that an actual amount of correction to be made significantly depends on the individual difference of the display device 100 whether a data signal is corrected or a scanning signal is corrected.

Hence, it is desirable to set the correction amount for each device.

If block boundaries are at the same position with respect to a vertical scanning period (frame), then the locations where irregularities occur tend to be fixed, making it easier to be visually recognized as irregularities. Furthermore, there are some cases where it is difficult to completely eliminate irregularities even when the configuration for making corrections at block boundaries is used.

Hence, if each frame has a different block boundary, then it becomes difficult to visually recognize irregularities even if the irregularities take place. Using, for example, a configuration wherein the polarity indicating signal POL is output according to the table shown in FIG. 20 causes a block boundary to shift for each frame. Therefore, on a basis of a few frames, irregularities look averaged to naked eye, making it difficult to visually recognize them as irregularities.

Obviously, the shifting may be upward, although it is downward in FIG. 20. As an alternative, in the configuration wherein the block boundary is shifted as set forth above, corrections may be made at a block boundary or the number of scanning lines making up a block may be changed as necessary.

Of the above, in the former configuration for making corrections at a block boundary, the non-selection voltage may be supplied rather than applying the selection voltage. This is, in other words, to avoid the execution of writing that causes the occurrence of irregularities in a certain frame. This is because, since the block boundary is shifted, the display will not be affected much as long as writing is executed in the following (or preceding) frame even if the writing is not executed in a certain frame.

The descriptions will now be given of the configuration in which a block boundary is shifted, and the non-selection voltage rather than the selection voltage is supplied to the scanning line 312 selected first in a block.

In this configuration, the polarity indicating signal POL is output according to the table shown in FIG. 21. The table itself is the same as that shown in FIG. 20.

However, in the horizontal scanning period during which the scanning line 312 is to be selected first in the block, the control circuit 400 sets the control signal INH to the H level during the circled periods in FIG. 21 showing the details.

If the control signal INH is at the H level, then the AND circuit 353 (refer to FIG. 5) closes, so that even if the transfer signal goes to the H level, the transfer signal will not be supplied to the voltage selection signal generating circuit 354. As mentioned above, unless the supplied transfer signal switches to the H level, the voltage selection signal generating circuit 354 will not recognize the horizontal scanning period during which the corresponding scanning line 312 is to be selected; hence, the voltage selection signal generating circuit 354 outputs the voltage selection signal b or c for maintaining the non-selection voltage in the immediately preceding frame.

Figure 23:
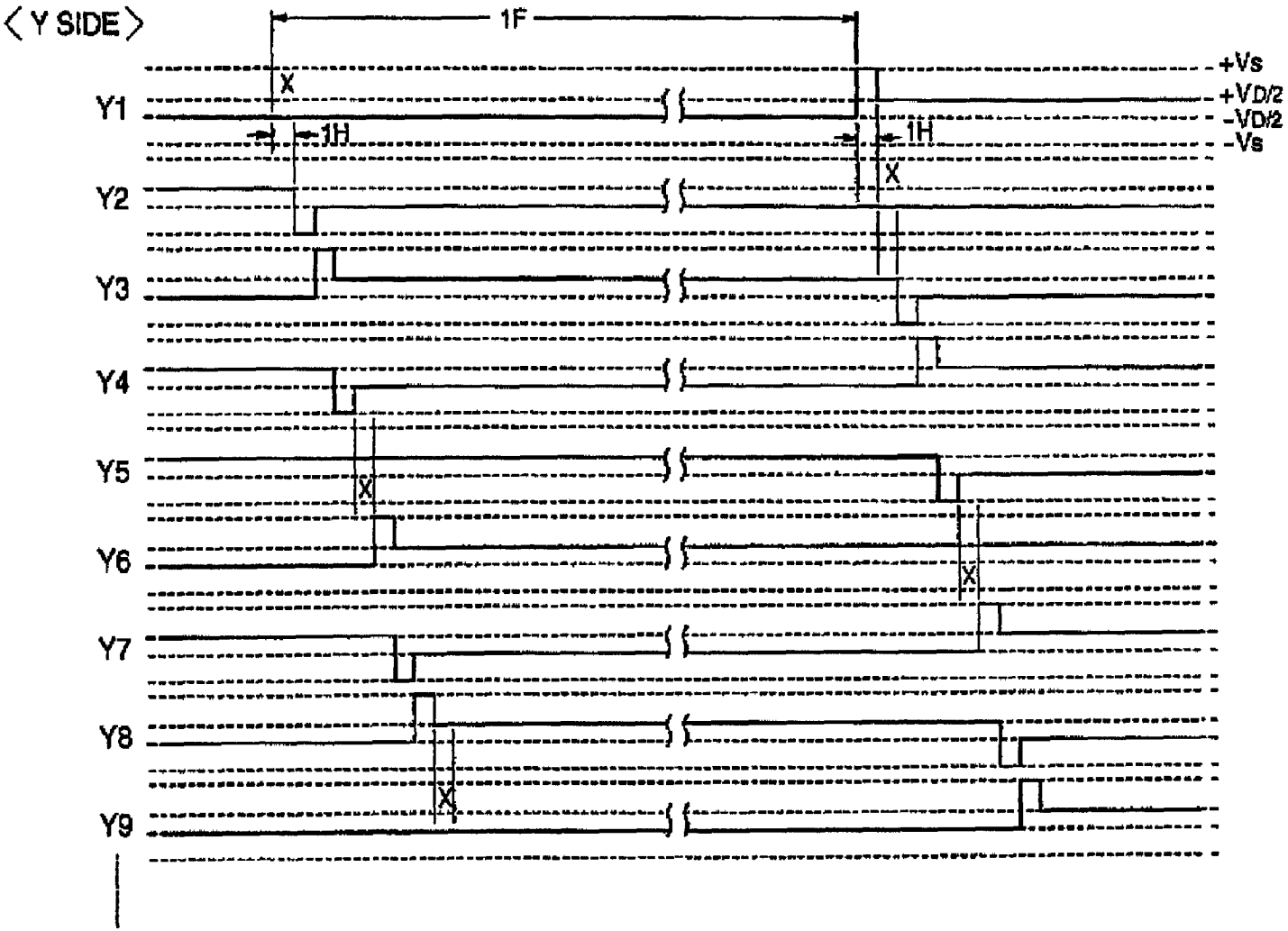
FIG. 23 is a diagram for explaining the voltage waveforms of scanning signals in the display device.

Thus, the scanning signal in this configuration is applied such that, for example, the immediately preceding non-selection voltage will be maintained instead of the selection voltage being applied to the scanning lines 312 of the 1st line, the 5th line, the 9th line, . . . in one frame, as shown in FIG. 23. Furthermore, the immediately preceding non-selection voltage will be maintained instead of the selection voltage being applied to the scanning lines 312 of the 2nd line, the 6th line, (the 10th line), . . . in the following second frame.

Accordingly, in this configuration, the writing that causes irregularities to occur will not be executed to begin with, making it possible to restrain the degradation in display quality level.

In this example, the non-selection voltage in place of the selection voltage is applied to the scanning line selected first in a block; however, if a block boundary is shifted upward, then the non-selection voltage in place of the selection voltage will be applied to the scanning line selected last in a block.

There is, however, a possibility of the occurrence of cross talk attributable to the writing not being executed. For example, therefore, a data signal or a scanning signal may be corrected to adjust the effective value of the voltage applied to a pixel at the time of selection after one frame elapses since writing is skipped, more specifically, in the circled periods in FIG. 24 so as to avoid the cross talk. The corrections may be made one frame before the period in which writing is skipped. At all events, it is considered desirable that the period in which writing is skipped and the period in which a correction is made are not temporally spaced away.

Alternatively, a configuration may be used in which the control circuit 400 outputs the polarity indicating signal POL according to the table shown in FIG. 24, and switches the control signal INH to the H level in the periods circled in the diagram. According to this configuration, in the horizontal scanning period wherein the scanning line 312 positioned last in a block is selected, the voltage applied to the scanning line and the voltage applied to the scanning lines of the preceding and following lines both remain to be the non-selection voltage. For this reason, it is considered that there will be less noises or the like affecting the first scanning line of the following block to be selected next.

Thus, in this configuration also, the streak-like irregularities in a block boundary will be smaller. The correction for making up the skipped application of the selection voltage may be implemented one frame before or after the skipping period.

In this example, the non-selection voltage is applied, in place of the selection voltage, to the scanning line selected last in a block. If, however, a block boundary is shifted upward, then the non-selection voltage instead of the selection voltage will be applied to the scanning line selected first in a block. At all events, it is also desirable that the period in which writing is skipped and the period in which a correction is made are not temporally spaced away.

The embodiment has been configured to select the scanning lines 312 in order one at a time from the top to supply the selection voltage thereto. It should be understood that the order of selection, however, is not limited thereto. For instance, the frames may be replaced by odd-numbered fields and even-numbered fields, so that the scanning lines 312 of, for example, odd-numbered lines are selected in sequence in the odd-numbered fields, while the scanning lines 312 of, for example, even-numbered lines are selected in sequence in the even-numbered fields (interlaced). With this arrangement, the number of scanning lines to be selected in one field will be reduced to half, and the operating frequency will be reduced to half, making it possible to achieve reduced power consumption accordingly.

Alternatively, the interlaced scanning may be carried out at every one or more scanning lines 312. Furthermore, one screen may be divided into a plurality of regions in the horizontal scanning direction, so that the divided regions are selected in sequence and the scanning lines 312 are selected in sequence from, for example, the top in a selected divided region.

In the above embodiment, the descriptions have been given of the case where the 8-gray scale display is performed with the 3-bit gray scale data. It should however be understood that the present invention is not limited thereto. Alternatively, binary display based on simple 1-bit gray scale (ON-OFF) data may be used, or 4-gray scale display based on 2-bit gray scale data may be used, or 16, 32, 64, . . . , $2^n$ gray scale display based on 4-bit, 5-bit, 6-bit, . . . , n-bit gray scale data may be used.

Moreover, three pixels of R (red), G (green), and B (blue) may constitute one dot to perform color display.

Furthermore, in the embodiment, the descriptions have been given of the case of the normally white mode in which white display is provided when no voltage is applied to the liquid crystal capacitor. Alternatively, a normally black mode in which black display is provided under the same condition may be used.

In addition, the embodiment has been the transmissive type, alternatively, however, it may be a reflective type or a transflective type that combines the two.

The X driver 250 in the embodiment has been configured to share the count result C provided by the counter 2540 for each column, as shown in FIG. 9. As an alternative configuration, however, the counter may be provided for each column to carry out comparison with latched gray scale data in magnitude.

The embodiment has been configured to apply the ON voltage contributing to the black display such that the ON voltage is temporally biased backward when the selection voltage is applied. Alternatively, however, the embodiment may be configured so as to apply the ON voltage temporally forward.

In addition, according to the embodiment, the application period of the data voltage $\pm V_D/2$ is adjusted on the basis of the display color of a pixel and the selection voltage of a scanning line so as to generate a data signal. Alternatively, however, a data signal may be supplied in which the voltage itself is defined according to the display color of a pixel and the selection voltage of a scanning line.

The embodiment has been configured to invert the writing polarity of the liquid crystal capacitor for each vertical scanning period. As an alternative configuration, however, the writing polarity may be inversely driven at a cycle of, for example, two or more vertical scanning periods.

The TFD 220 in the display device 100 described above is connected to the data line 212 side, while the liquid crystal capacitor 118 is connected to the scanning line 312 side. Conversely, however, the TFD 220 may be connected to the scanning line 312 side, while the liquid crystal capacitor 118 may be connected to the data line 212 side.

The TFD 220 is just an example of the two-terminal type switching element. Other elements including a ZnO (zinc oxide) varistor or an element using an MSI (Metal Semi-Insulator) or the like, or a device that connects these two elements in series or parallel in opposite directions may be used as the two-terminal type switching elements.

The present invention may be applied also to a passive matrix type display device that drives pixels without using the switching elements, such as the TFD 220.

In the embodiment, the descriptions have been given of the case where the TN type or the STN type liquid crystal is used; however, a guest-host type liquid crystal may be used in which a dye (guest) exhibiting anisotropy in the absorption of visible light in the molecular major axis and minor axis is dissolved in a liquid crystal (host) having a predetermined molecular disposition, and the dye molecules are arranged in parallel to the liquid crystal molecules.

In addition, a configuration of vertical orientation (homeotropic orientation) may be used in which the liquid crystal molecules are disposed vertically with respect to both substrates when no voltage is applied, whereas the liquid crystal molecules are disposed horizontally with respect to both substrates when a voltage is applied. Another alternative configuration of parallel (horizontal) orientation (homogeneous orientation) may be used in which the liquid crystal molecules are disposed horizontally with respect to both substrates when no voltage is applied, whereas the liquid crystal molecules are disposed vertically with respect to both substrates when a voltage is applied.

Thus, a variety of liquid crystals and alignment systems can be used as long as they are adaptable to the driving method in accordance with the present invention.

The descriptions will now be given of an improved structure of the display device 100 intended for achieving further improved display quality level. According to the embodiment described above, the power consumption of the display device 100 can be reduced, while restraining the occurrence of the cross talk shown in FIG. 16 at the same time. However, there is a likelihood in which a horizontal streak-shaped irregularity is displayed in a boundary portion of a block having a plurality of bundled scanning lines due to the capacitive coupling between pixel electrodes. Hence, the construction of the display device 100 itself will be improved so as to restrain the occurrence of such a display irregularity. The following will exemplify three improved structures regarding the element board 200 constituting a part of the display device 100.

These improved structures share a common aspect in which a conductive portion that has conducting properties, such as the data line 212 or a conductive line 280 is provided between adjoining pixel electrodes 234 in such a manner that it is electrically isolated from the pixel electrodes 234.

Figure 28:
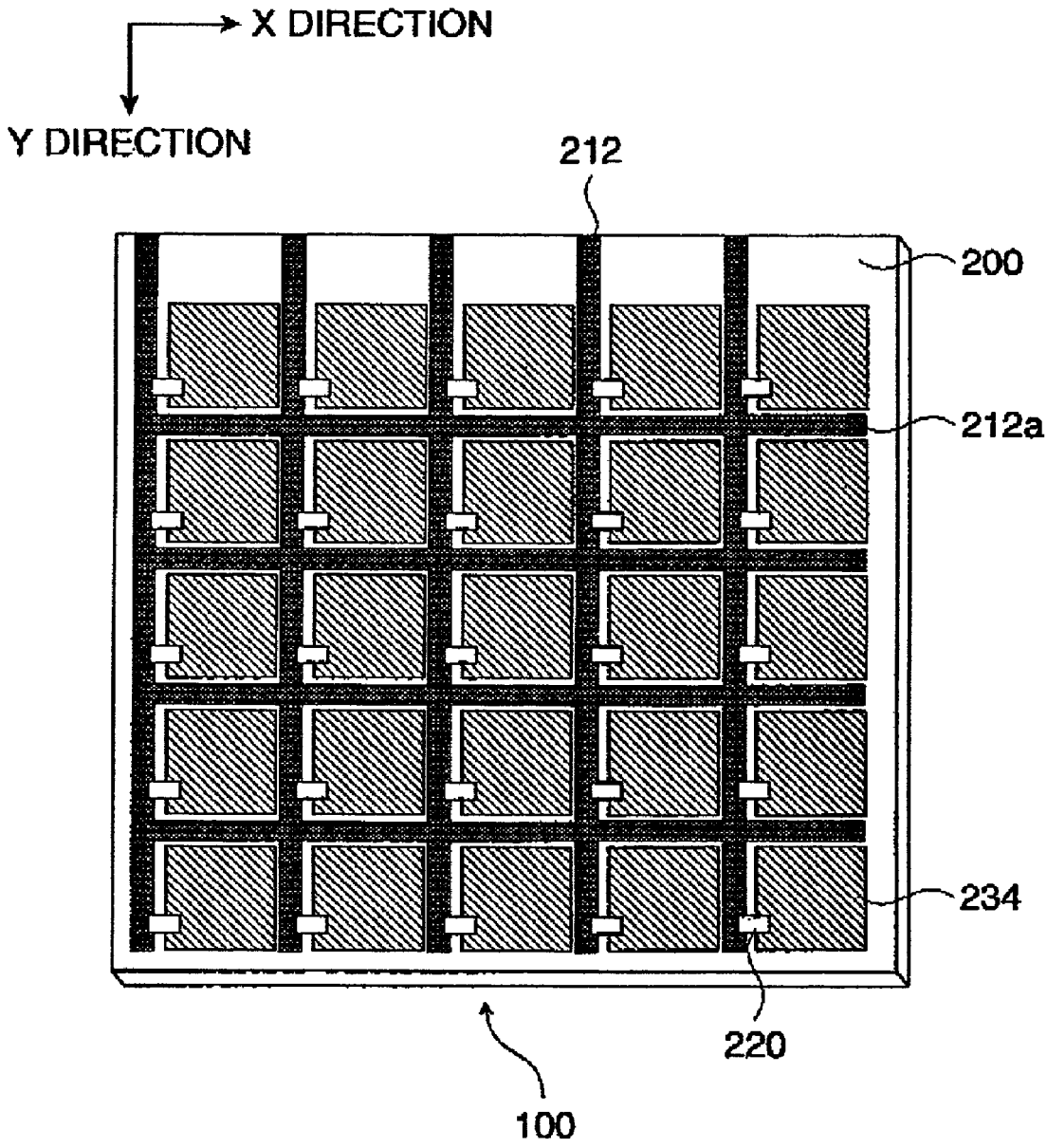
FIG. 28 is a top view of an element board according to a first improved structure.

FIG. 28 is a top view of an element board 200 according to a first improved structure. In the drawing, the like members as those of the above embodiment will be assigned the like reference numerals, and the detailed explanation thereof will be omitted. As in the case of the above embodiment, data lines 212, TFDs 220, and pixel electrodes 234 are provided on the opposing surface of the element board 200.

The element board 200 is structurally characterized in that a part of each of the data lines 212 is projected in an "L" shape to provide the data line with a projecting portion 212*a*. To be more specific, the projecting portion 212*a* projects in an X direction (lateral (right) direction), which is different from the direction in which the data line 212 extends (Y direction), and exists between two adjoining pixel electrodes 234 in the Y direction. The projecting portion 212*a* and the pixel electrodes 234 are electrically isolated by being spaced away from each other on the opposing surface of the element board 200 or laminated through the intermediary of an insulating film. The projecting portions 212*a* are provided between all adjacent pixel electrodes present on the element board 200. The distal end of the projecting portion 212*a* provided on a certain data line 212 is spaced away from the data line 212 immediately to the right. Hence, the right and left adjoining data lines 212 are electrically isolated from each other.

Thus, by providing the projecting portion 212*a* between the two pixel electrodes 234 adjacent to each other in the Y direction, the projecting portion 212*a* functions as an electrostatic shield for reducing the parasitic capacitor between the adjacent pixel electrodes 234. This will effectively restrain the horizontal streak-shaped irregularity displayed in a block boundary area.

Figure 29:
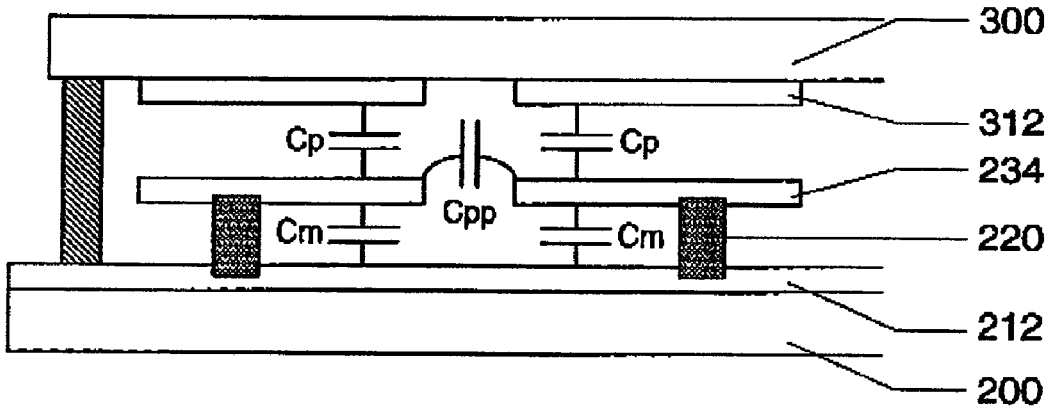
FIG. 29 is a diagram showing a model of a parasitic capacitor between pixels in a structure without projecting portions.

First, the mechanism of the occurrence of a horizontal streak-like display irregularity will be explained. FIG. 29 is a diagram showing a model of the parasitic capacitor between pixels in a structure without the projecting portions 212*a*. In the diagram, Cm denotes the parasitic capacitor between a pixel electrode and a data line, Cp denotes the parasitic capacitor between a pixel electrode and a scanning line, and Cpp denotes the parasitic capacitor between two adjoining pixel electrodes. The model shown in FIG. 29 can be represented by an equivalent circuit shown in FIG. 30. In the drawing, the voltage of the scanning line (common 1 in the drawing) and the voltage of the data line (segment in the drawing) are being applied to a pixel p1. Furthermore, the voltage of a scanning line (common 2 in the drawing) different from common 1 and the voltage of a data line (segment) are being applied to a pixel p2 adjacent to the pixel p1 in the X direction.

In general, if a voltage Vb of one of the pixel electrodes changes by ΔVb, then a change ΔVa of the other pixel electrode voltage Va adjacent thereto is expressed as $(Vpp/(Cm+Cp+Cpp))\cdot\Delta Vb$. A state is assumed in which the pixel voltage at the moment the writing of pixel p1 on the common 1 has been completed is denoted as −Vp1, and the writing to the pixel p2 on the common 2 has been completed.

Figure 31:
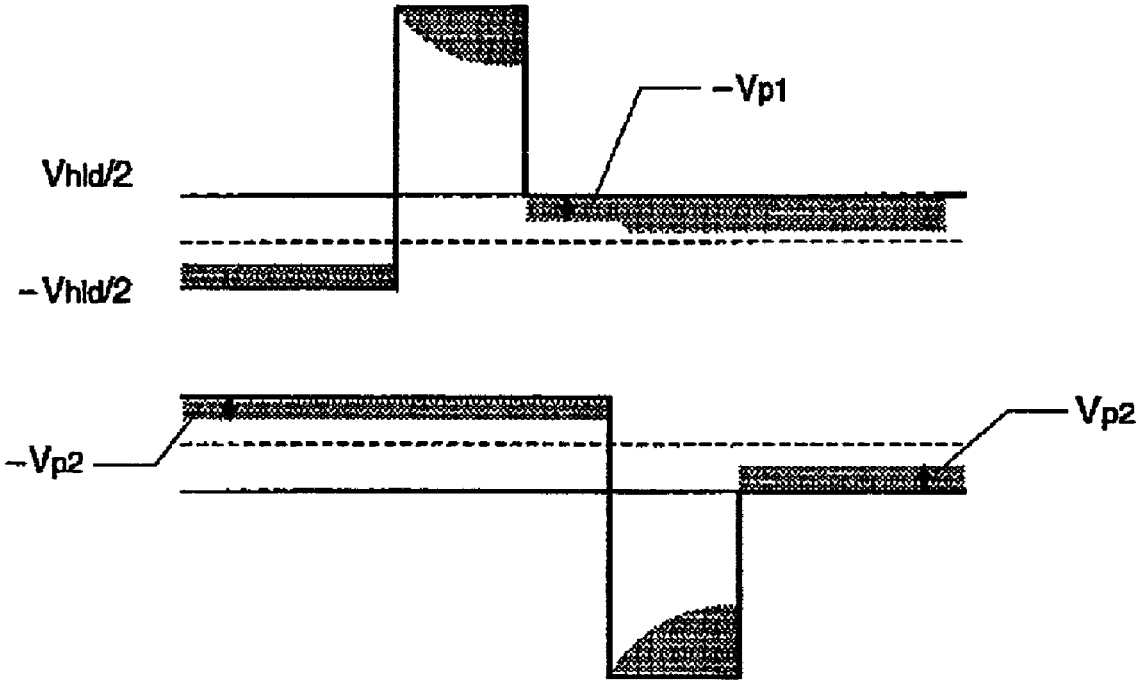
FIG. 31 is a diagram showing the voltage changes of a pixel voltage and a holding voltage.

First, if the pixel p1 and the pixel p2 have reverse writing polarities (inverse polarity writing), then the pixel voltage of the pixel p2 changes from −Vp2 to Vp2 before and after the writing, respectively, and the holding voltage thereof changes from Vhld/2 to −Vhld/2 (refer to FIG. 31).

Figure 30:
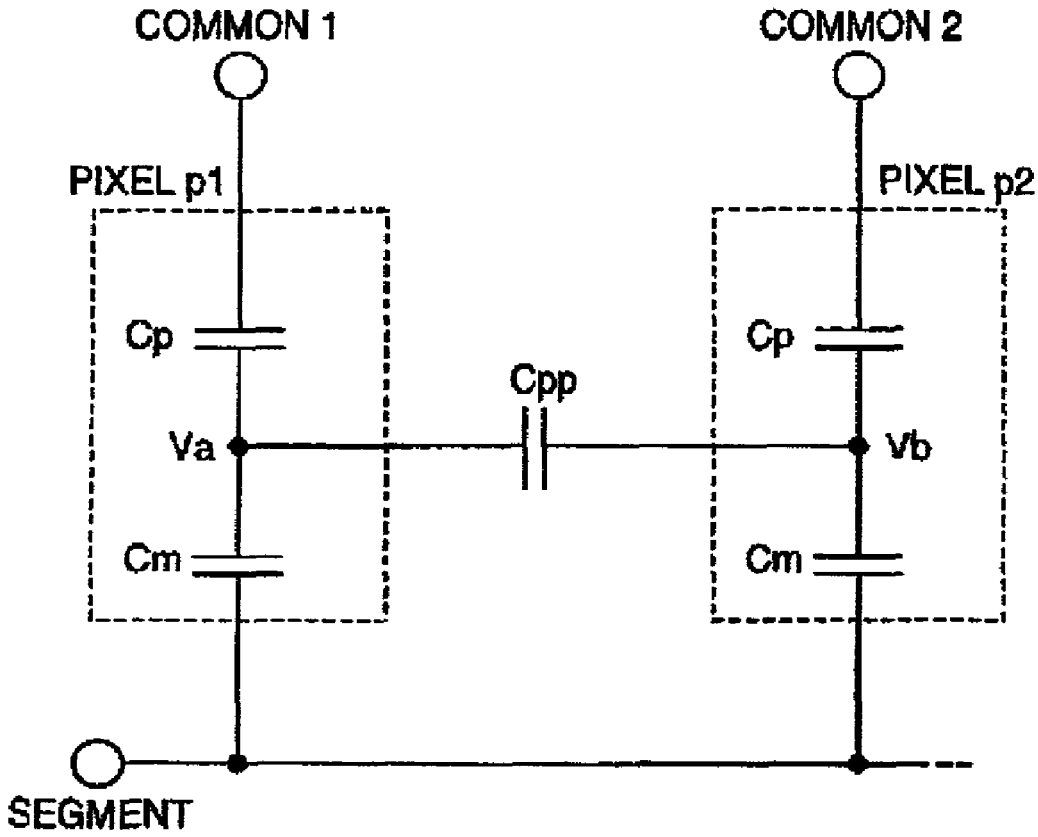
FIG. 30 is a diagram showing equivalent circuits of two adjacent pixels in the structure without the projecting portions.

When this is regarded as the change in the voltage Vb of the one pixel electrode shown in FIG. 30, the voltage changes from (Vhld/2−Vp2) to (Vp2−Vhld/2), and ΔVb will be (2Vp2−Vhld). Therefore, if 2Vp2<Vhld, then ΔVa changes to the negative side, resulting in an increased absolute value of the pixel voltage of the pixel p1 (the display becoming darker).

Figure 32:
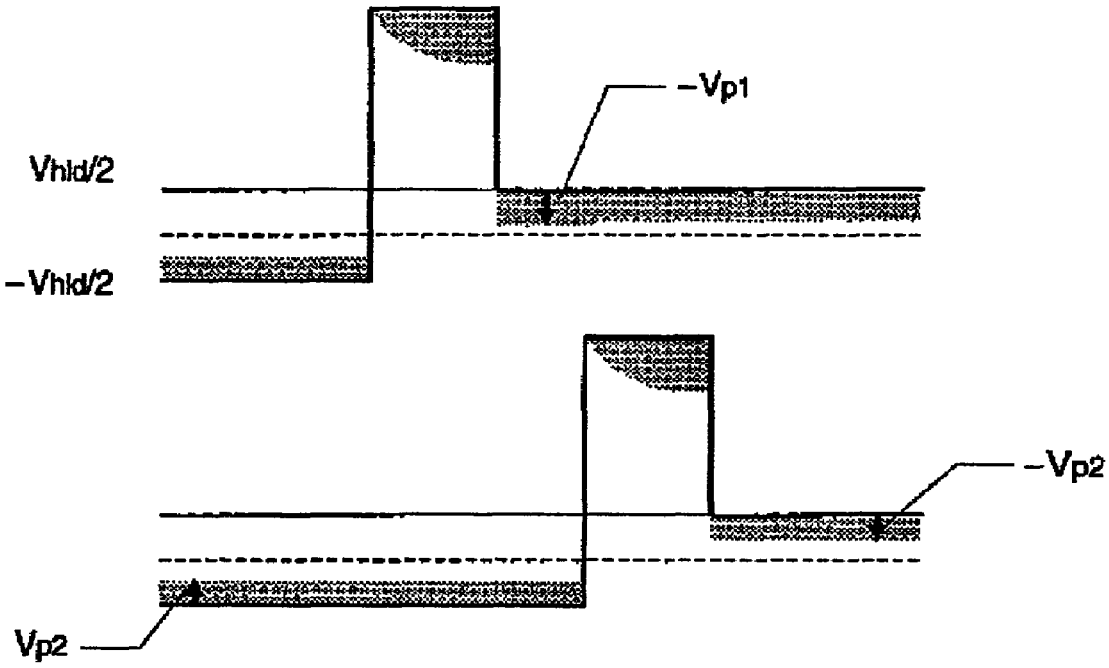
FIG. 32 is a diagram showing the voltage changes of a pixel voltage and a holding voltage.

Meanwhile, if the pixel p1 and the pixel p2 have the same writing polarity (same polarity writing), then the pixel voltage of the pixel p2 changes from Vp2 to −Vp2 before and after the writing, respectively, and the holding voltage thereof changes from −Vhld/2 to Vhld/2 (refer to FIG. 32).

When this is regarded as the change in the voltage Vb of the one pixel electrode shown in FIG. 30, the voltage changes from (Vhld/2−Vp2) to (Vp2−Vhld/2), and ΔVb will be (Vhld−2Vp2). Therefore, if 2Vp2<Vhld, then ΔVa changes to the positive side, resulting in a decreased absolute value of the pixel voltage of the pixel p1 (the display becoming brighter).

If it is assumed that the pixel voltage ranges from about 1V(off) to about 3V(on) and the holding voltage Vhld is about 4V, then ΔVb will be $\pm 2\cdot|Vp2-Vhld|=\pm 2V$. Furthermore, if it is assumed that (Cpp/(Cm+Cp+Cpp)) is about 0.01, then there will be a difference of 40 mv (20 mV×2) in the effective voltage between the inverse polarity writing and the same polarity writing, leading to the occurrence of a display irregularity. This means that the intensity of the pixels of a certain written line will be different, depending upon the writing polarity of the next written line. According to the driving method in accordance with the embodiment, the polarity will always be inversed in the same block, while it will be the same polarity in a block boundary area. As a result, the horizontal streak-like irregularity takes place in the block boundary area.

Figure 33:
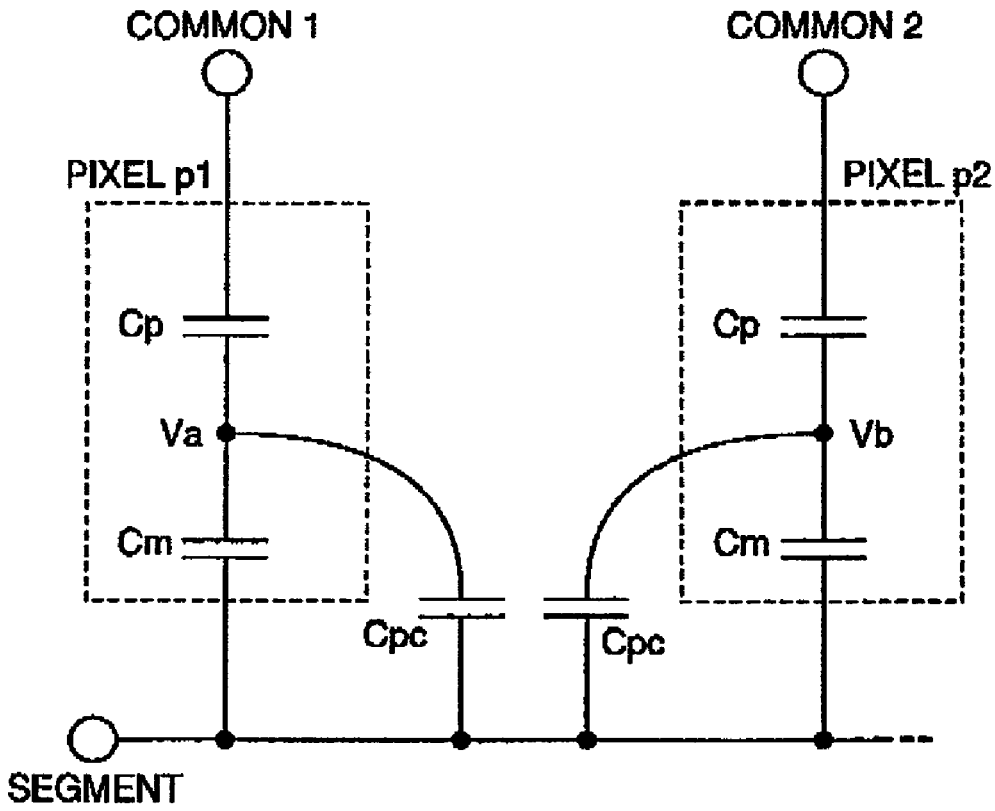
FIG. 33 is a diagram showing an equivalent circuit of two adjacent pixels in a structure provided with projecting portions.

In contrast to the above, when the data line 212 is provided with the projecting portion 212*a*, the equivalent circuit of the adjacent two pixels is as shown in FIG. 33. A parasitic capacitor Cpc is newly formed between the pixel electrodes 234 of the individual pixels and the projecting portion 212*a*. Providing the parasitic capacitor Cpc reduces the parasitic capacitor Cpp between the adjacent pixel electrodes 234. This will reduce (Cpp/(Cm+Cp+Cpp)) to a sufficiently small value, so that a voltage change in one pixel electrode 234 causes less voltage fluctuation in the other pixel electrode 234.

In other words, the projecting portion 212*a* functions as an electrostatic shield for controlling the voltage fluctuation in pixel electrodes attributable to the parasitic capacitor Cpp. As a result, the occurrence of the horizontal streak-like irregularities in a block boundary can be effectively reduced even without making corrections by a drive circuit.

Figure 34:
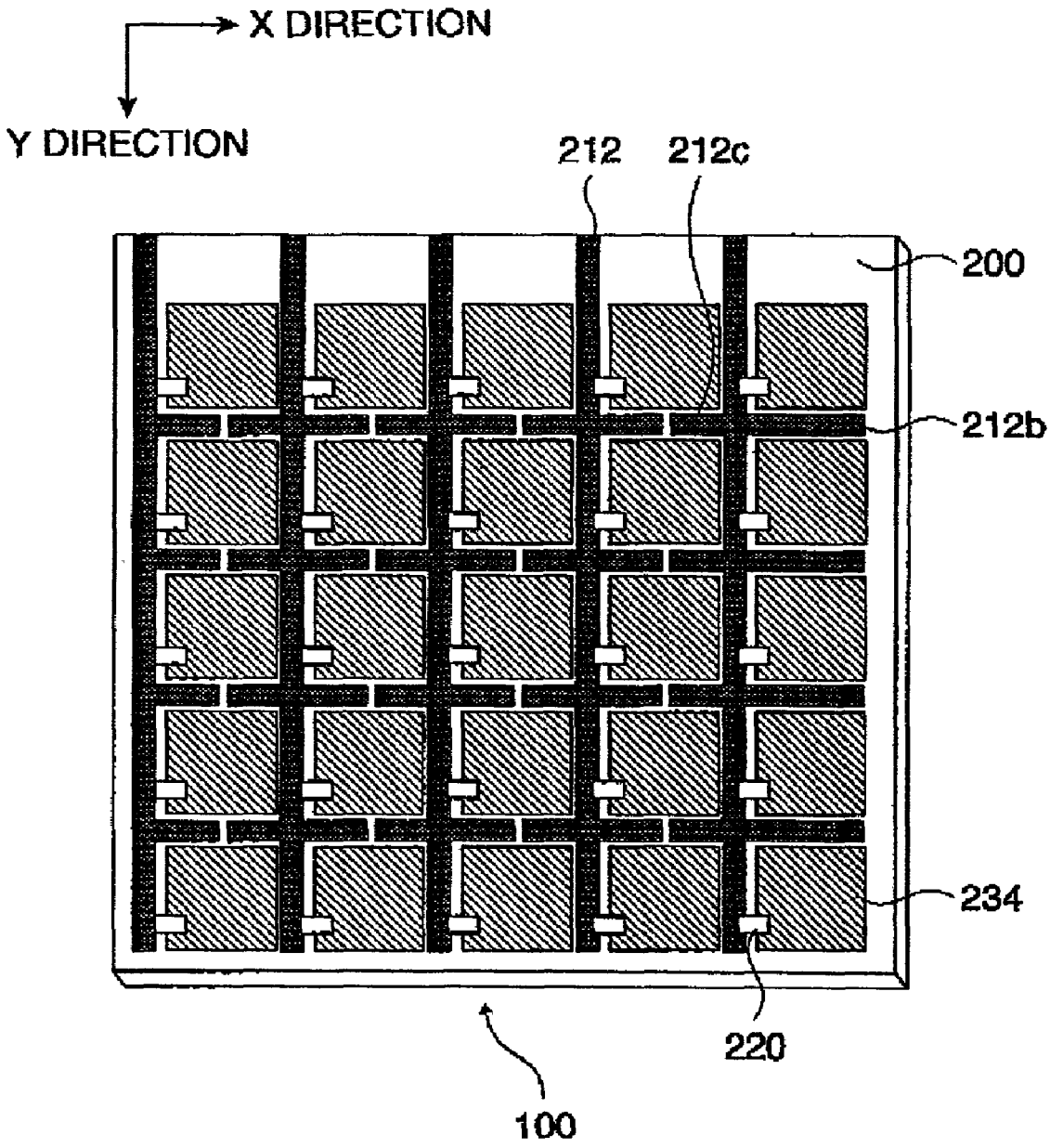
FIG. 34 is a top view showing an element board according to a second improved structure.

FIG. 34 is a top view of the element board 200 according to a second improved structure. The element board 200 is structurally characterized in that a part of the data line 212 is projected substantially into a cross shape so as to provide the data line 212 with projecting portions 212*b* and 212*c*. To be more specific, the right projecting portion 212*b* protrudes rightward, while the left projecting portion 212*c* protrudes leftward. As in the case of the first improved structure, these projecting portions 212*b* and 212*c* exist between the two pixel electrodes 234 adjoining in the Y direction and are electrically isolated from the pixel electrodes 234. Furthermore, at least either the projecting portions 212*b* or 212*c* is interjacent among all adjacent pixel electrodes existing on the element board 200. The distal end of the right projecting portion 212*b* provided on a certain data line 212 is spaced away from the distal end of the left projecting portion 212*c* provided on the data line 212 immediately to the right, hence, the vertically adjacent data lines 212 are electrically isolated from each other.

With such a construction, the parasitic capacitor Cpc formed between the projecting portions 212*b*, 212*c* and the pixel electrodes 234 causes the projecting portions 212*b* and 212*c* to function as electrostatic shields. As a result, the voltage fluctuation in the adjacent pixel electrodes 234 attributable to the parasitic capacitor Cpp is reduced, as in the case of the first improved structure. This makes it possible to effectively reduce the occurrence of horizontal streak-like irregularities in a block boundary area without making corrections by a drive circuit.

Figure 35:
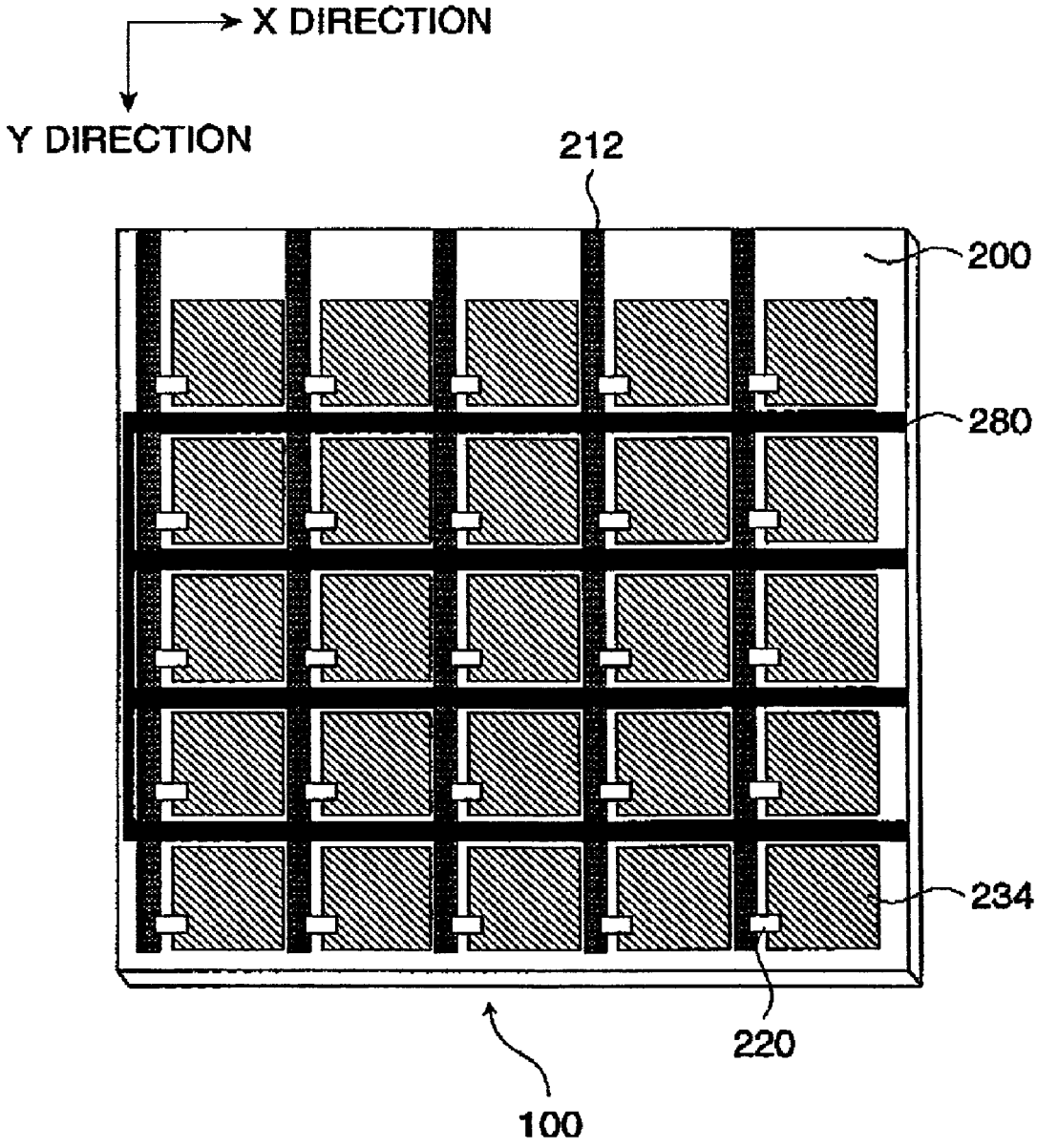
FIG. 35 is a top view showing an element board according to a third improved structure.

FIG. 35 is a top view of an element board 200 according to a third improved structure. The element board 200 is structurally characterized in that a plurality of conductors 280 are provided using a separate member from that of the data line 212. To be more specific, the individual conductors 280 extend in a different direction from the data lines 212 and are electrically isolated from the data lines 212 through the intermediary of insulating films. Each conductor 280 lies between two pixel electrodes 234 adjoining in the Y direction. The plurality of conductors 280 are commonly connected at the left end in FIG. 35. The material of the conductors 280 is preferably a transparent electrically conductive material, such as an indium oxide or tin oxide. This will prevent the display from becoming dark.

With such a construction, parasitic capacitors Cpc are newly formed between the conductors 280 and the pixel electrodes 234. Therefore, the individual conductors 280 function as electrostatic shields, so that it is possible to effectively reduce the occurrence of horizontal streak-like irregularities in a block boundary area without making corrections by a drive circuit.

Preferably, a certain voltage (the voltage does not have to be a constant voltage) is always applied to the conductors 280; however, the conductors 280 may be floating in a structure wherein numerous conductors 280 are commonly connected (a structure immune to the influences of capacitive coupling).

The descriptions will now be given of the examples in which the display devices in accordance with the embodiment set forth above are used with electronic equipment.

Figure 25:
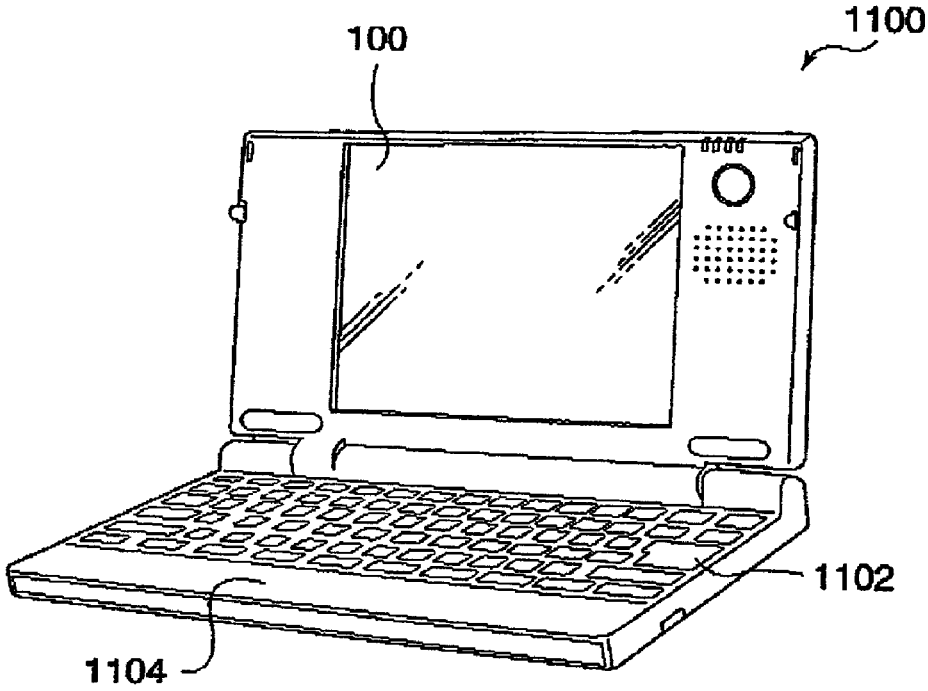
FIG. 25 is a perspective view showing the construction of a personal computer, which is an example of electronic equipment to which the display device according to the embodiment has been applied.

First, an example will be explained in which the display device 100 described above has been applied to the display unit of a personal computer. FIG. 25 is a perspective view showing the construction of the personal computer.

In the drawing, a computer 1100 has a main unit 1104 provided with a keyboard 1102, and the display device 100 used as the display unit. If a transmissive liquid crystal device is used as the display device 100, then a backlight (not shown) is provided at the back to secure visibility in a dark place.

Figure 26:
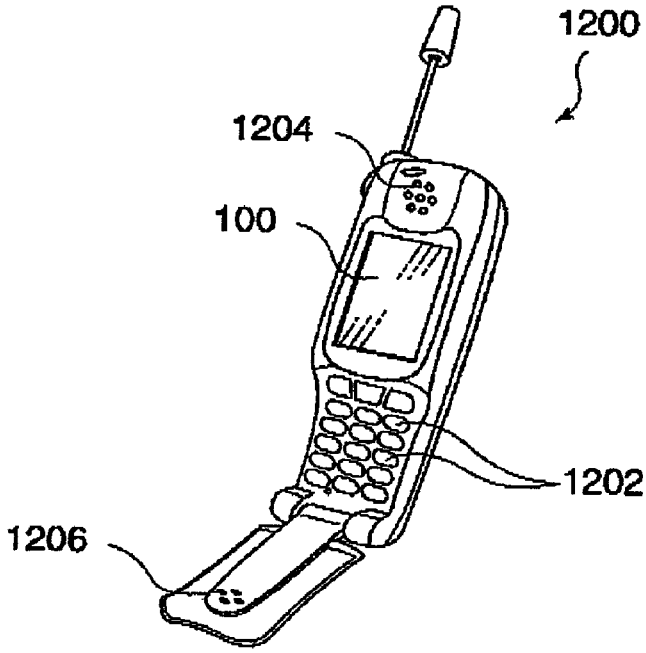
FIG. 26 is a perspective view showing the construction of a cellular telephone, which is an example of electronic equipment to which the display device has been applied.

The description will be given of an example wherein the aforesaid display device 100 has been applied to the display unit of a cellular telephone. FIG. 26 is a perspective view showing the construction of the cellular telephone.

In the drawing, a cellular telephone 1200 is equipped with a plurality of control buttons 1202, an ear piece 1204, a mouth piece 1206, and the aforesaid display device 100. If a liquid crystal device is used as the display device 100, then a backlight is provided for a transmissive type or a transflective type, or a front light is provided for a reflective type (none of these being shown) in order to secure visibility in a dark place.

The descriptions will now be given of a digital still camera in which the aforesaid display device has been used as a finder thereof.

Figure 27:
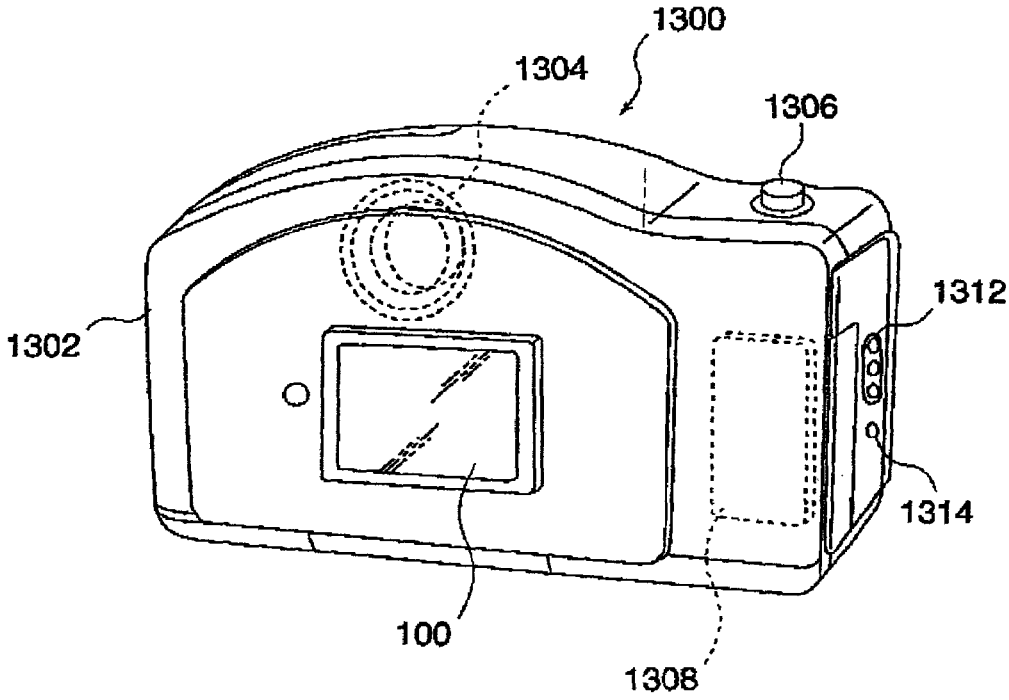
FIG. 27 is a perspective view showing the construction of the back face of a digital still camera, which is an example of electronic equipment to which the display device has been applied.

FIG. 27 is a perspective view showing the back face of the digital still camera. A regular silver salt camera exposes a film by a light image of an object, while a digital still camera 1300 photoelectrically converts the light image of an object by an imaging device, such as a CCD (Charge Coupled Device), to generate an imaging signal. The aforesaid display device 100 is provided on the back face of a case 1302 in the digital still camera 1300, and carries out display on the basis of the imaging signals supplied by the CCD. Hence, the display device 100 functions as a finder displaying objects. The front face (the back face in FIG. 28) of the case 1302 is provided with a light receiving unit 1304 that includes optical lenses, a CCD, etc.

In this case, when a photographer confirms an object image displayed on the display device 100 and depresses a shutter button 1306, the imaging signal in the CCD at that point is transferred to and stored in a memory of a circuit board 1308.

In the digital still camera 1300, a side surface of the case 1302 is provided with a video signal output terminal 1312 and an input/output terminal 1314 for data communication in order to perform external display.

As electronic equipment, there are a liquid crystal television, a view-finder type or a monitor direct-viewing type video tape recorder, a car navigation apparatus, a pager, an electronic databook, a calculator, a word processor, a workstation, a videophone, a POS terminal, equipment provided with a touch panel, and the like, in addition to the personal computer shown in FIG. 25, the cellular telephone shown in FIG. 26, and the digital still camera shown in FIG. 27. And it is needless to say that the display device described above can be applied as the display unit of these diverse types of electronic equipment.

ADVANTAGES

As described above, according to the present invention, it is possible to reduce power consumption while restraining the degradation in display quality at the same time.

What is claimed is:

1. A drive circuit of a display device for driving pixels provided in correspondence with intersections of scanning lines and data lines, comprising:

a scanning line drive circuit that selects the scanning lines on a one-by-one basis, and applies a selection voltage to the selected scanning line, while applying a non-selection voltage to all other scanning lines, a plurality of an odd number of the scanning lines being bundled into a block, a polarity of the selection voltage being reversed each time one scanning line is selected on the basis of an intermediate value of an ON voltage and an OFF voltage applied to the data lines in a block, a selection voltage of a scanning line lastly selected in a block being set to the same polarity as that of a selection voltage of a scanning line firstly selected in a block following the aforesaid block;

a data line drive circuit that, when a scanning line is selected and the selection voltage is applied thereto, applies one of the ON voltage and the OFF voltage on the basis of information to be displayed by a pixel associated with an intersection of the scanning line and the data line and the polarity of the selection voltage to the data line;

wherein the scanning line drive circuit shifts the boundary of the blocks in sequence for each vertical scanning period, the scanning line drive circuit applying the non-selection voltage in place of the selection voltage to the scanning line that is selected firstly or lastly in a block.

2. The drive circuit of a display device according to claim 1, the number of scanning lines constituting a block being different from the number of scanning lines constituting a block following the aforesaid block.

3. The drive circuit of a display device according to claim 1, the data line drive circuit correcting the ON voltage or the OFF voltage at least when the selection voltage is applied to the scanning line firstly selected in a block or when the selection voltage is applied to the scanning line lastly selected in a block.

4. The drive circuit of a display device according to claim 1, the scanning line drive circuit correcting the selection voltage or an application time of the selection voltage at least when the selection voltage is applied to the scanning line firstly selected in a block or when the selection voltage is applied to the scanning line lastly selected in a block.

5. The drive circuit of a display device according to claim 1, the scanning line drive circuit forming the scanning lines into blocks, such that a boundary of the blocks is shifted in sequence for each vertical scanning period.

6. The drive circuit of a display device according to claim 5, the data line drive circuit correcting the ON voltage or the OFF voltage when the selection voltage is applied to a scanning line selected firstly or lastly in a block.

7. The drive circuit of a display device according to claim 5, the scanning line drive circuit correcting the selection voltage or the application time of the selection voltage at least when the selection voltage is applied to the scanning line firstly selected in a block or when the selection voltage is applied to the scanning line lastly selected in a block.

8. The drive circuit of a display device according to claim 1, wherein the scanning line drive circuit applies the non-selection voltage to the scanning line selected firstly or lastly in a block, even if the scanning line selected firstly or lastly in the block was firstly applied a selection voltage, so as to restrain an occurrence of a display difference.

9. A driving method for a display device driving pixels provided in correspondence with intersections of scanning lines and data lines, comprising:

selecting the scanning lines on a one-by-one basis, and applying a selection voltage to the selected scanning line, while applying a non-selection voltage to all other scanning lines;

bundling a plurality of an odd number of the scanning lines into a block, reversing a polarity of the selection voltage each time one scanning line is selected on the basis of an intermediate value of an ON voltage and an OFF voltage applied to the data lines in a block;

setting a selection voltage of a scanning line lastly selected in a block to the same polarity as that of a selection voltage of a scanning line firstly selected in a block following the aforesaid block;

applying, when a scanning line is selected and the selection voltage is applied thereto, the ON voltage or the OFF voltage to a data line on the basis of information to be displayed by a pixel associated with an intersection of the scanning line and the data line and the polarity of the selection voltage;

shifting a boundary of the blocks in sequence for each vertical scanning period; and applying the non-selection voltage in place of the selection voltage to the scanning line that is selected firstly or lastly in a block.

10. The driving method of claim 9, wherein the scanning line drive circuit applies the non-selection voltage to the scanning line selected firstly or lastly in a block, even if the scanning line selected firstly or lastly in the block was firstly applied a selection voltage, so as to restrain an occurrence of a display difference.

11. A display device equipped with pixels provided at intersections of scanning lines and data lines, comprising:

a scanning line drive circuit that selects the scanning lines on a one-by-one basis, and applies a selection voltage to the selected scanning line, while it applies a non-selection voltage to all other scanning lines, a plurality of an odd number of the scanning lines being bundled into a block, a polarity of the selection voltage being reversed each time one scanning line is selected on the basis of an intermediate value of an ON voltage and an OFF voltage applied to the data lines in a block, the scanning line drive circuit setting the selection voltage of the scanning line selected last in a block and the selection voltage of the scanning line selected first in a block following the aforesaid block to the same polarity;

a data line drive circuit that, when a scanning line is selected and the selection voltage is applied thereto, applies one of the ON voltage and the OFF voltage on the basis of information to be displayed by a pixel associated with an intersection of the scanning line and the data line and the polarity of the selection voltage to a data line; and wherein the scanning line drive circuit shifts the boundary of the blocks in sequence for each vertical scanning period, the scanning line drive circuit applying the non-selection voltage in place of the selection voltage to the scanning line that is selected firstly or lastly in a block.

12. The display device according to claim 11 comprising:

a plurality of the scanning lines, a plurality of the data lines, and a plurality of pixels provided at intersections of the scanning lines and the data lines, each of the pixels including a pixel electrode and a two-terminal type switching element provided between the pixel electrode and the data line, and an electrically conductive portion that is electrically isolated from the pixel electrode is disposed between pixel electrodes adjoining in a direction in which the data lines extend.

13. The display device according to claim 12 the electrically conductive portion being a projecting portion formed by projecting a part of the data line in a different direction from the direction in which the data line extends.

14. The display device according to claim 12 further comprising a plurality of electrically conductive lines that are electrically isolated from the data lines, extend in a different direction from the direction in which the data lines extend, and are respectively connected in common, each of the electrically conductive lines corresponding to the electrically conductive portion.

15. The display device according to claim 11 the pixel including:

a two-terminal type switching element having one end thereof connected to one of the scanning line and the data line; and an electro-optical capacitor having an electro-optical material sandwiched between the other one of scanning line and the data line and a pixel electrode connected to another end of the two-terminal type switching element.

16. The display device according to claim 15 the two-terminal type switching element having a structure in which an insulating member is sandwiched between electrically conductive members.

17. Electronic equipment comprising the display device according to claim 11.

18. The display device according to claim 11 wherein the scanning line drive circuit applies the non-selection voltage to the scanning line selected firstly or lastly in a block, even if the scanning line selected firstly or lastly in the block was firstly applied a selection voltage, so as to restrain an occurrence of a display difference.

19. A drive circuit of a display device for driving pixels provided in correspondence with the intersections of scanning lines and data lines, comprising:

a scanning line drive circuit that selects the scanning lines on a one-by-one basis, and applies a selection voltage to the selected scanning line, while applying a non-selection voltage to all other scanning lines, a plurality of an odd number of the scanning lines being bundled into a block, a polarity of the selection voltage being reversed each time one scanning line is selected on the basis of an intermediate value of an ON voltage and an OFF voltage applied to the data lines in a block, a selection voltage of a scanning line lastly selected in a block being set to the same polarity as that of a selection voltage of a scanning line firstly selected in a block following the aforesaid block; and a data line drive circuit that, when a scanning line is selected and the selection voltage is applied thereto, applies one of the ON voltage and the OFF voltage on the basis of information to be displayed by a pixel associated with an intersection of the scanning line and the data line and the polarity of the selection voltage to the data line, the scanning line drive applying the non-selection voltage in place of the selection voltage to the scanning line that is selected firstly or lastly in a block.

20. The drive circuit of a display device according to claim 19 wherein the scanning line drive circuit applies the non-selection voltage to the scanning line selected firstly or lastly in a block, even if the scanning line selected firstly or lastly in the block was firstly applied a selection voltage, so as to restrain an occurrence of a display difference.

* * * * *